US007695101B2

(12) United States Patent
Samoto et al.

(10) Patent No.: US 7,695,101 B2
(45) Date of Patent: Apr. 13, 2010

(54) IMAGE RECORDING APPARATUS

(75) Inventors: Kenji Samoto, Nagoya (JP); Toshio Sugiura, Anjou (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 832 days.

(21) Appl. No.: 11/071,742

(22) Filed: Mar. 4, 2005

(65) Prior Publication Data

US 2005/0195242 A1 Sep. 8, 2005

(30) Foreign Application Priority Data

Mar. 8, 2004 (JP) ..... 2004-063921

(51) Int. Cl.
*B41J 23/00* (2006.01)

(52) U.S. Cl. ..... 347/37

(58) Field of Classification Search ..... 347/37–39, 347/8, 19; 400/618, 691
See application file for complete search history.

(56) References Cited

U.S. PATENT DOCUMENTS

| | | | | |
|---|---|---|---|---|
| 4,178,469 | A * | 12/1979 | Fork | 174/489 |
| 5,026,185 | A * | 6/1991 | Kusabuka | 400/618 |
| 5,195,836 | A * | 3/1993 | Longust et al. | 400/354 |
| 5,807,003 | A | 9/1998 | Kobayashi et al. | |
| 6,056,461 | A | 5/2000 | Yun | |
| 6,394,568 | B1 * | 5/2002 | Menendez | 347/8 |
| 6,419,334 | B1 * | 7/2002 | Akuzawa et al. | 347/8 |
| 6,439,787 | B1 * | 8/2002 | Kerr | 400/691 |
| 6,688,739 | B2 * | 2/2004 | Murray | 347/104 |
| 6,789,966 | B2 | 9/2004 | Tanaka et al. | |
| 2003/0007023 | A1 * | 1/2003 | Barclay et al. | 347/8 |
| 2003/0043229 | A1 * | 3/2003 | Kawatoko et al. | 347/37 |
| 2003/0076379 | A1 * | 4/2003 | Yusef et al. | 347/37 |

FOREIGN PATENT DOCUMENTS

| | | |
|---|---|---|
| EP | 0 351 854 | 1/1990 |
| EP | 0540265 | 10/1992 |
| EP | 0 540 265 | 5/1993 |
| EP | 0577376 A2 | 6/1993 |

(Continued)

OTHER PUBLICATIONS

Notification of First Office Action, Patent Office of the People's Republic of China, issued Nov. 24, 2006.

(Continued)

*Primary Examiner*—Stephen D Meier
*Assistant Examiner*—Alexander C Witkowski
(74) *Attorney, Agent, or Firm*—Banner & Witcoff, Ltd

(57) ABSTRACT

An image recording apparatus includes: a carriage that carries a recording head capable of recording an image on a recording medium and reciprocates in a main scanning direction; a substantially box-shaped main frame having an open upper side and a pair of side plates extending in a sub-scanning direction orthogonal to the main scanning direction; and first and second guide members over which the carriage extends and by which the carriage is guided, the first and second guide members being disposed to be apart from each other by a predetermined distance in the sub-scanning direction, extended in the main scanning direction at the upper side of the main frame and fixed to the pair of side plates.

22 Claims, 25 Drawing Sheets

FOREIGN PATENT DOCUMENTS

| | | | |
|---|---|---|---|
| JP | 2-33308 | | 7/1990 |
| JP | 2-33309 | | 7/1990 |
| JP | 2-33310 | | 7/1990 |
| JP | 5254213 | A | 10/1993 |
| JP | 6014567 | A | 1/1994 |
| JP | 7257800 | A | 10/1995 |
| JP | 7299939 | A | 11/1995 |
| JP | 8309966 | A | 11/1996 |
| JP | 2001-260475 | | 9/2001 |
| WO | WO 9812437 | A1 * | 3/1998 |

OTHER PUBLICATIONS

European Search report for Application No. 05 25 1355, completed Jul. 5, 2005.

Office Action issued Mar. 25, 2009, in corresponding Japanese Application No. 2004-063921.

* cited by examiner 22
21h
67
21g
21f
61
21a
X
Y
Z

IMAGE RECORDING APPARATUS

BACKGROUND OF THE INVENTION

1. Field of the Invention

The present invention relates to an image recording apparatus of an ink-jet type or the like, and more particularly to a structure of a main frame to house a main part.

2. Description of the Related Art

A conventional image recording apparatus of an ink-jet type, a thermal-head type or the like is such that as disclosed in JP-A-11-246055 (see FIG. 1 and FIG. 5) or JP-A-2001-260475 (see FIGS. 1 to 4), cylindrical guide shafts to support a carriage carrying a recording head in such a manner that the carriage can reciprocate in a main scanning direction, a paper feed roller, a paper discharge roller, and the like are disposed in the inside of a box-type main frame made of a metal plate and fixed in a synthetic resin housing of the image recording apparatus. Both ends of these shafts are attached to right and left side plates of the main frame so as to be pivotally supported.

Besides, the structure is such that a paper feed cassette is housed at the lower side in the main frame to be capable of being pulled out and inserted, and after a sheet is transported to the lower surface of the recording head through the paper feed roller and a U-turn-shaped transporting passage and is recorded, the sheet is discharged to the front side of the housing.

Further, JP-A-2002-254746 (see FIG. 1 and FIG. 3) discloses that a pair of guide plates which support a carriage and can reciprocate it in a main scanning direction are integrally provided in a main frame.

SUMMARY OF THE INVENTION

According to the structure disclosed in JP-A-2002-254746, since an additional member is not required for a guide shaft and the like, the cost can be reduced. However, in order to accurately guide the carriage in the main scanning direction and a sub-scanning direction orthogonal thereto, and to accurately set a gap between a recording head and a recording medium, it is required that the guide plates are accurately and firmly attached to the main frame. Besides, although a maintenance unit part for maintenance of the recording head is disposed at one end part in the main scanning direction, when the length of the main frame in the main scanning direction is made long for that purpose, there arise a problem that a wasteful space is produced and the image recording apparatus becomes large. Further, in the case where a paper feed cassette is disposed below the main frame, a space for vertical movement of a paper feed roller is required, and there arises a problem that the height size of the image recording apparatus becomes large.

The present invention provides an image recording apparatus in which a carriage (recording head) can be operated at high accuracy and which is compact.

According to an aspect of the invention, there is provided an image recording apparatus including: a carriage that carries a recording head capable of recording an image on a recording medium and reciprocates in a main scanning direction; a substantially box-shaped main frame having an open upper side and a pair of side plates extending in a sub-scanning direction orthogonal to the main scanning direction; and first and second guide members over which the carriage extends and by which the carriage is guided, the first and second guide members being disposed to be apart from each other by a predetermined distance in the sub-scanning direction, extended in the main scanning direction at the upper side of the main frame and fixed to the pair of side plates.

According to the aspect of the invention, since the two lines of guide members are fitted to the pair of side plates of the main frame formed into the box shape having an open upper side, although the structure is very simple, the rigidity of the main frame becomes high, and the strong apparatus can be provided.

BRIEF DESCRIPTION OF THE DRAWINGS

The present invention may be more readily described with reference to the accompanying drawings.

DETAILED DESCRIPTION OF THE PREFERRED EMBODIMENTS

Now, an embodiment of the invention will be described.

Figure 1:
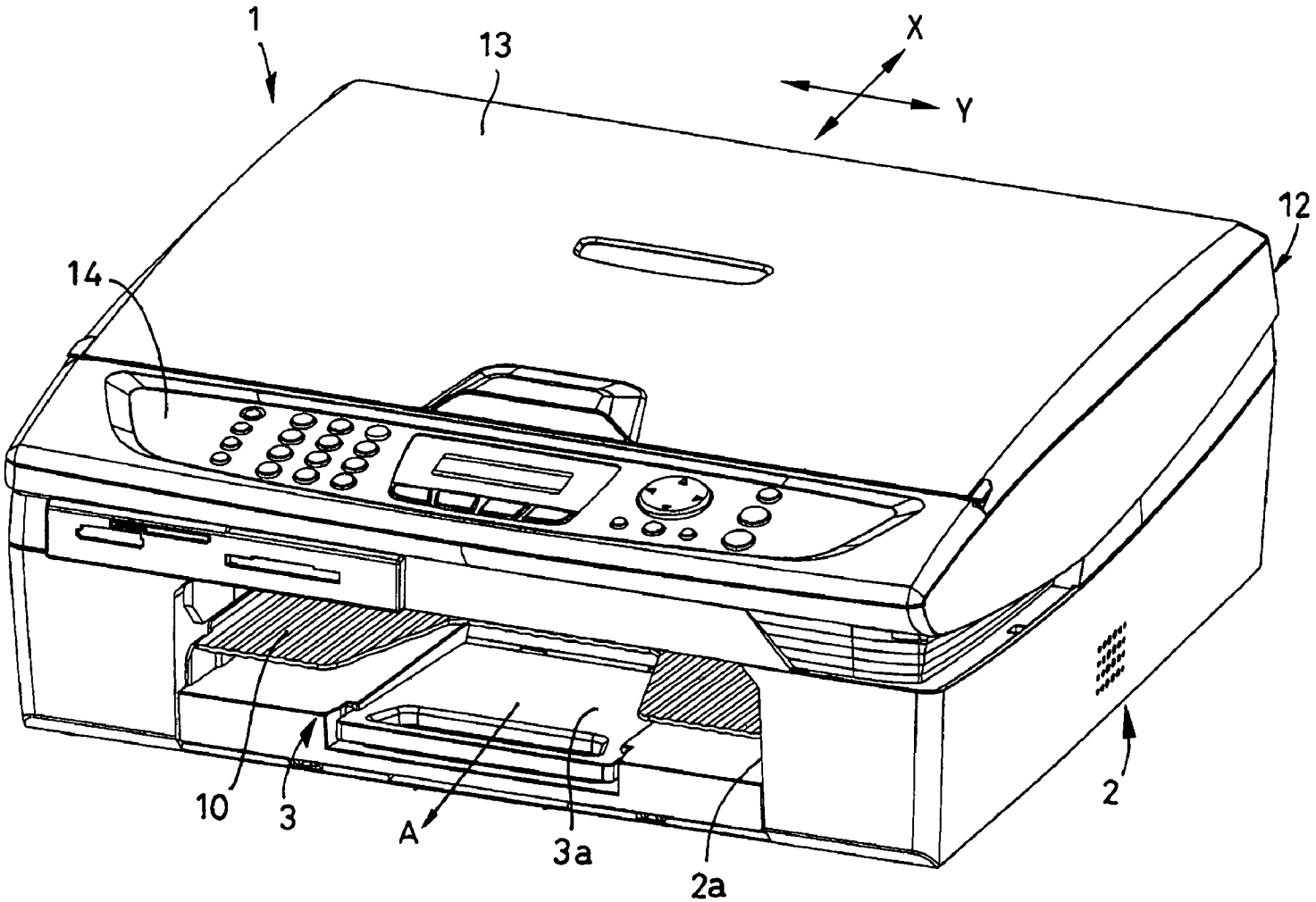
FIG. 1 is a perspective view of an image recording apparatus of an embodiment of the invention.
Figure 2:
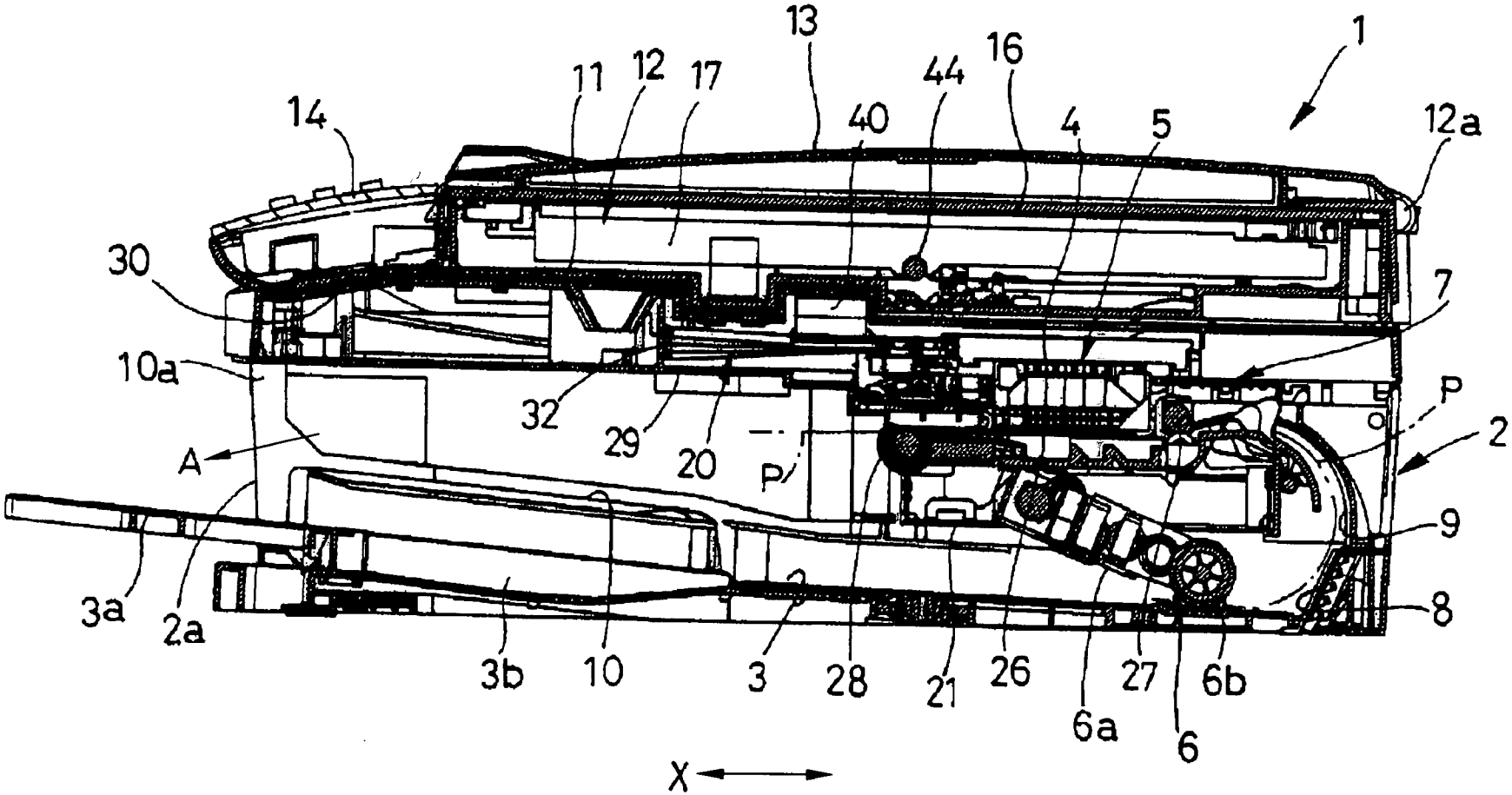
FIG. 2 is a side sectional view of the image recording apparatus of the embodiment of the invention.

An image recording apparatus 1 of this embodiment is a multi function device (MFD) having a printer function, a copy function, a scanner function and a facsimile function, to which the invention is applied. As shown in FIGS. 1 and 2, at a bottom part of a housing 2 which is a recording apparatus main body of synthetic resin in the image recording apparatus 1 and is made of an injection molded part of synthetic resin, a paper feed cassette 3 is disposed which can be inserted through an opening part 2*a* on the front side (left side in FIG. 2).

In this embodiment, the paper feed cassette 3 is made to have such a form that plural sheets P, each of which is a recording medium and is cut into, for example, A4 size, letter size, legal size, postcard size or the like, can be stacked (deposited) and housed in such a manner that its short side extends in a direction (direction orthogonal to the surface of the sheet of FIG. 2, main scanning direction, or Y-axis direction) orthogonal to a sheet transporting direction (sub-scanning direction, or X-axis direction). An auxiliary support member 3*a* to support the rear end part of the long sheet P of the legal size or the like is mounted at the front end of the paper feed cassette 3 such that it can be moved in the X-axis direction. Although FIG. 2 shows a state in which the auxiliary support member 3*a* is disposed at a position where it protrudes toward the outside from the housing 2, in the case where the sheet P of the A4 size or the like which can be contained in the paper feed cassette 3 (which does not protrude toward the outside from the opening part 2*a*) is used, the auxiliary support member 3*a* can be housed in a housing part 3*b* such that it does not block the paper feed.

A bank part 8 for sheet separation is disposed at the depth side (right side in FIG. 2) of the paper feed cassette 3. As described later in detail, a base end part of a paper feed arm 6*a* of a paper feed unit 6 is mounted to a bottom plate 21*b* of a box-shaped main frame 21 made of a metal plate and can swing in the vertical direction, and the sheet P as the recording medium stacked (deposited) on the paper feed cassette 3 is separated and transported one by one by a paper feed roller 6*b* provided at the lower end of the paper feed arm 6*a* and the bank part 8. The separated sheet P is fed to a recording part 7 provided at an upper side (high position) behind the paper feed cassette 3 through a U-turn path (feed path) 9 directed upward. As described later in detail, the recording part 7 includes a carriage 5 on which an ink-jet recording head 4 to realize the printer function and the like is mounted and which can reciprocate.

A paper discharge part 10 to which the sheet P recorded in the recording part 7 is discharged while its recording surface is turned upward, is formed above the paper feed cassette 3, and a paper discharge port 10*a* communicating with the paper discharge part 10 is opened in common with the front opening part 2*a* of the housing 2.

An image reading device 12 for reading a document in the copy function and the facsimile function is disposed at an upper part of the housing 2. A bottom wall 11 of the image reading device 12 is constructed to overlap from above an upper cover body 30 substantially without a gap. The image reading device 12 is constructed to be capable of opening/closing/swinging vertically with respect to one side end of the housing 2 through a not-shown pivot part. Further, a rear end of a document cover body 13 covering an upper surface of the image reading device 12 is mounted so that it can vertically swing on a pivot shaft 12*a* with respect to a rear end of the image reading device 12.

An operation panel part 14 including various operation buttons, a liquid crystal display part and the like is provided at the upper side of the housing 2 and in front of the image reading device 12. The recording part 7, the paper discharge part 10 and an ink storage part 15 provided at one side of this paper discharge part 10 are disposed to be positioned in a projection area of the image reading device 12 and the operation panel part 14 when viewed on a plane. In the state where the auxiliary support member 3*a* of the paper feed cassette 3 is housed in the housing part 3*b*, the length of the paper feed cassette 3 in the X-axis direction is almost equal to the length of the image reading device 12 plus the length of the operation panel part 14 in the X-axis direction. Accordingly, since this image recording apparatus 1 becomes a substantially rectangular parallelepiped having a substantially square shape when viewed on a plane, packing becomes easy at a time of packing when it is shipped as a product, and a box for packing can be miniaturized.

A glass plate 16 for placement on which a document can be placed after the document cover body 13 is opened upward, is provided on the upper surface of the image reading device 12, and at its lower side, an image scanner device (CIS: Contact Image Sensor) 17 for document reading is provided to be capable of reciprocating along a guide shaft 44 extending in the direction (main scanning direction, or Y-axis direction in FIGS. 2, 6 and 7) orthogonal to the surface of the sheet of FIG. 2.

Figure 3:
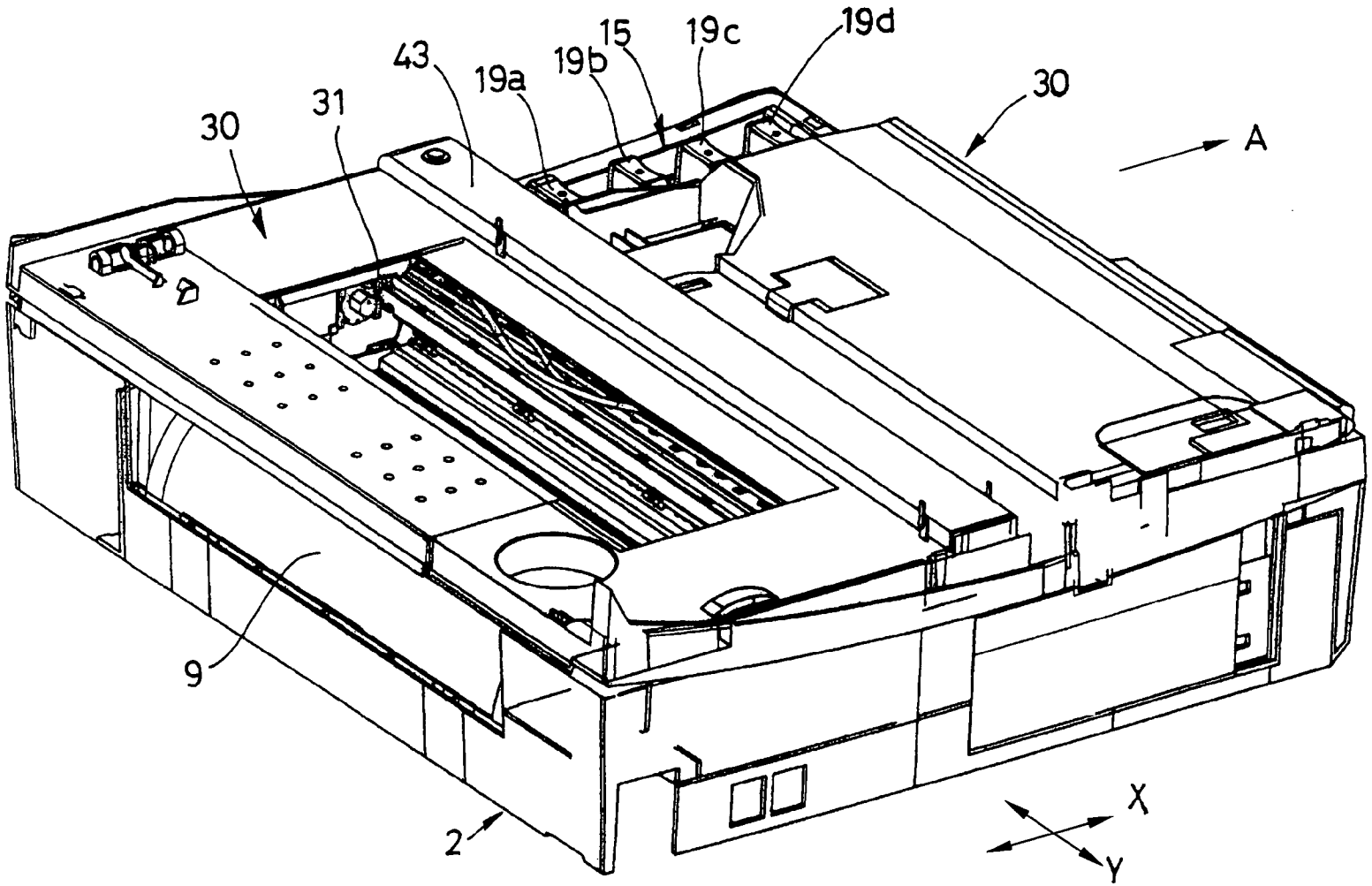
FIG. 3 is a perspective view of a recording apparatus main body.
Figure 4:
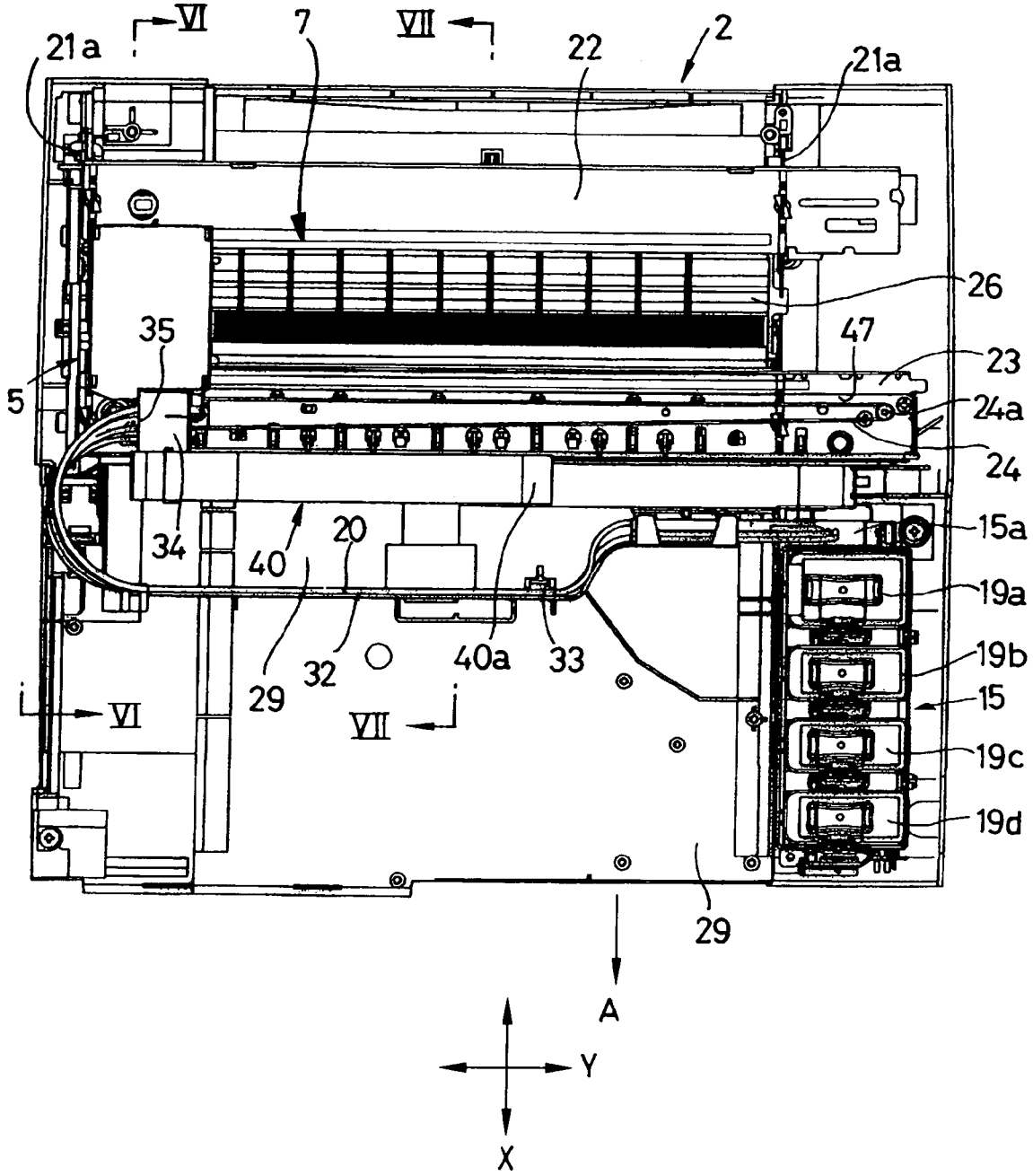
FIG. 4 is a plan view of the recording apparatus main body in a state where an upper cover body is removed.
Figure 5:
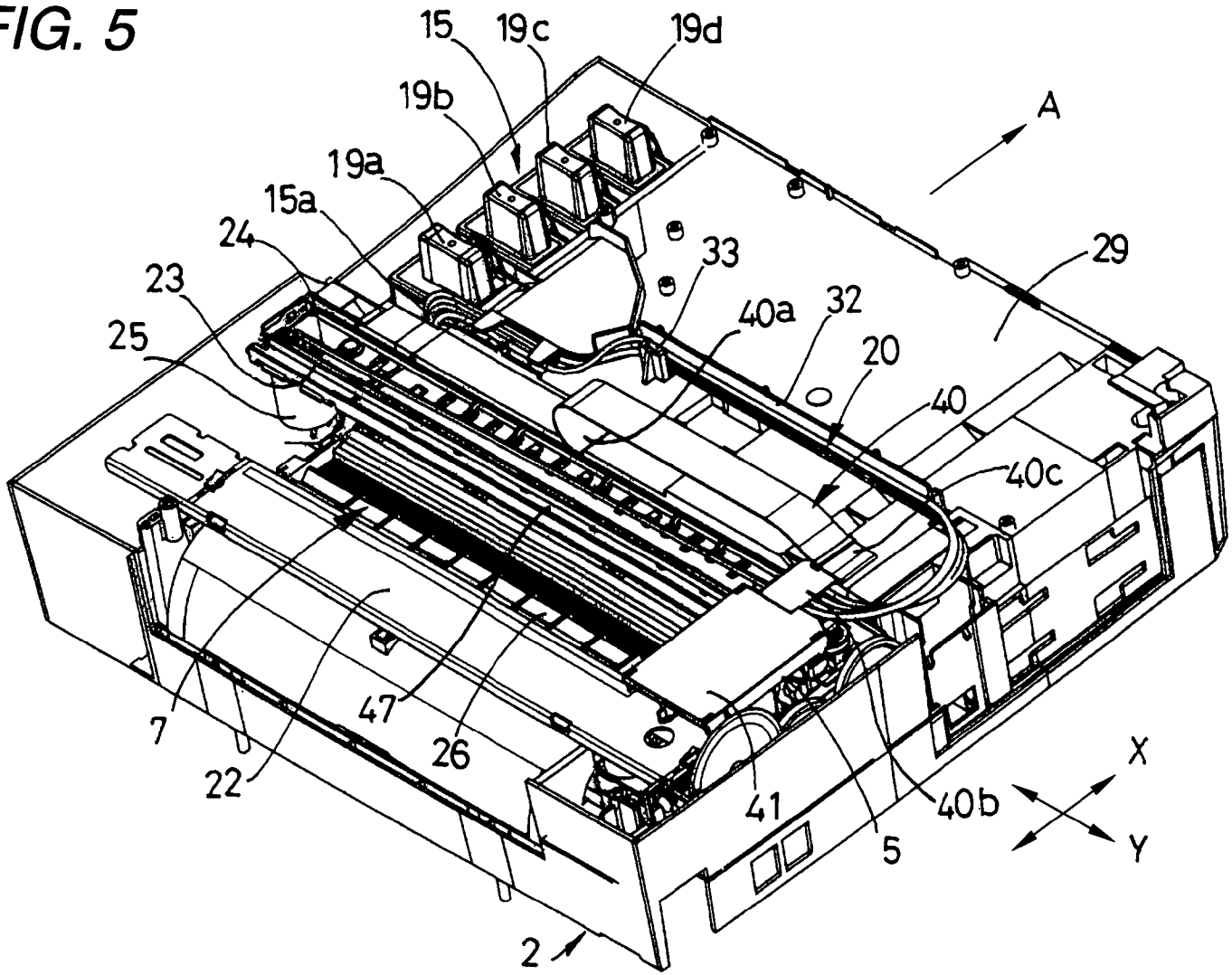
FIG. 5 is a perspective view of the recording apparatus main body in the state where the upper cover body is removed.

The ink storage part 15 is opened toward an upper part of the housing 2, and the ink storage part 15 is constructed such that ink cartridges 19 (cartridges for individual colors, that is, black (BK), cyan (C), magenta (M), and yellow (Y) are denoted by 19*a* to 19*d*, see FIGS. 3 to 5) which respectively contain four color inks for full-color recording, have small areas when viewed on a plane, have high height sizes, and have substantially rectangular box shapes can be housed along the X-axis direction, and can be detachably attached from above.

Figure 6:
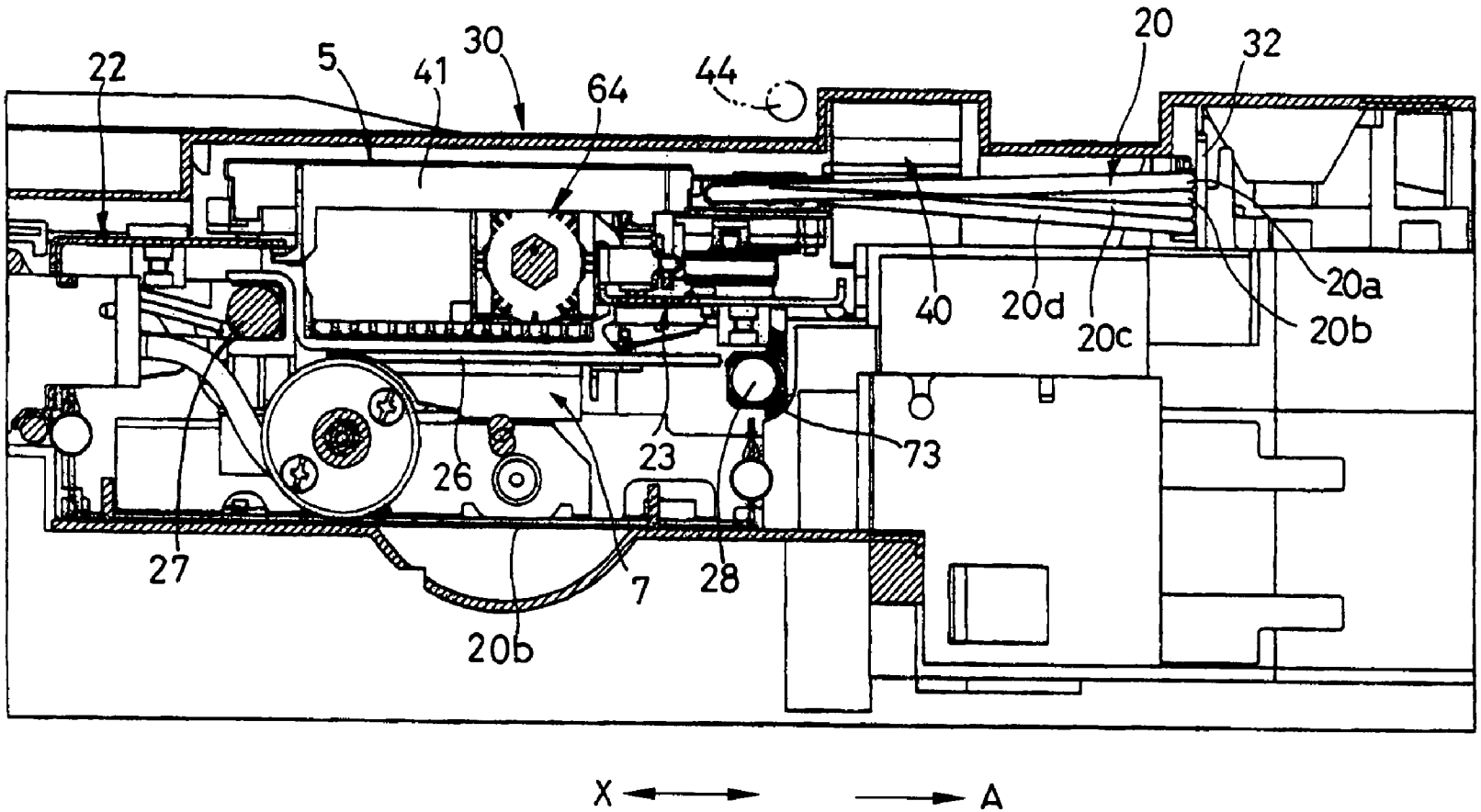
FIG. 6 is an enlarged side sectional view taken along line VI-VI of FIG. 4.

The inks are supplied from the respective ink cartridges 19 (individually denoted by 19*a* to 19*d*) to the ink-jet recording head 4 through plural (four in this embodiment) ink supply tubes (ink tubes) 20 (individually denoted by 20*a* to 20*d*, see FIG. 6). Incidentally, in the case where ink colors more than four colors are used (six to eight colors, etc.), the structure has only to be modified such that the ink cartridges the number of which corresponds to the number of the ink colors can be housed in the ink storage part 15, and the ink supply tubes 20 are also increased according to the number of the ink cartridges.

At the outside of the width (short side of the sheet P) of the sheet P to be transported, an ink receiving part (not shown) is disposed at one end side (in the embodiment, part near a left side plate 21*a* in FIGS. 3 and 13), and a maintenance unit 50 described later is disposed at the other end side (part near a right side plate 21*a* in FIGS. 3 and 13). By this, the recording head 4 periodically performs an ink discharge for preventing clogging of a nozzle at a flashing position provided in the ink receiving part during a recording operation, and ink is received by the ink receiving part. In the portion of the maintenance unit 50, the carriage 5 is located at a standby position, a cap part 50*a* in the maintenance unit 50 covers the nozzle surface of the recording head 4 from below and ink is selectively sucked for each color, or a recovery processing to remove bubbles in a not-shown buffer tank above the recording head 4 is performed. When the carriage 5 laterally moves to approach the portion of the maintenance unit 50, the nozzle surface is wiped by a not-shown cleaner (wiper blade) and cleaning is performed.

As shown in FIGS. 4 to 7, FIG. 11 and the like, the recording part 7 is supported by the box-type main frame 21 and the pair of right and left side plates 21*a* thereof, and is positioned between a first and a second horizontally long plate-shaped guide members 22 and 23 extending in the Y-axis direction (main scanning direction).

Figure 8:
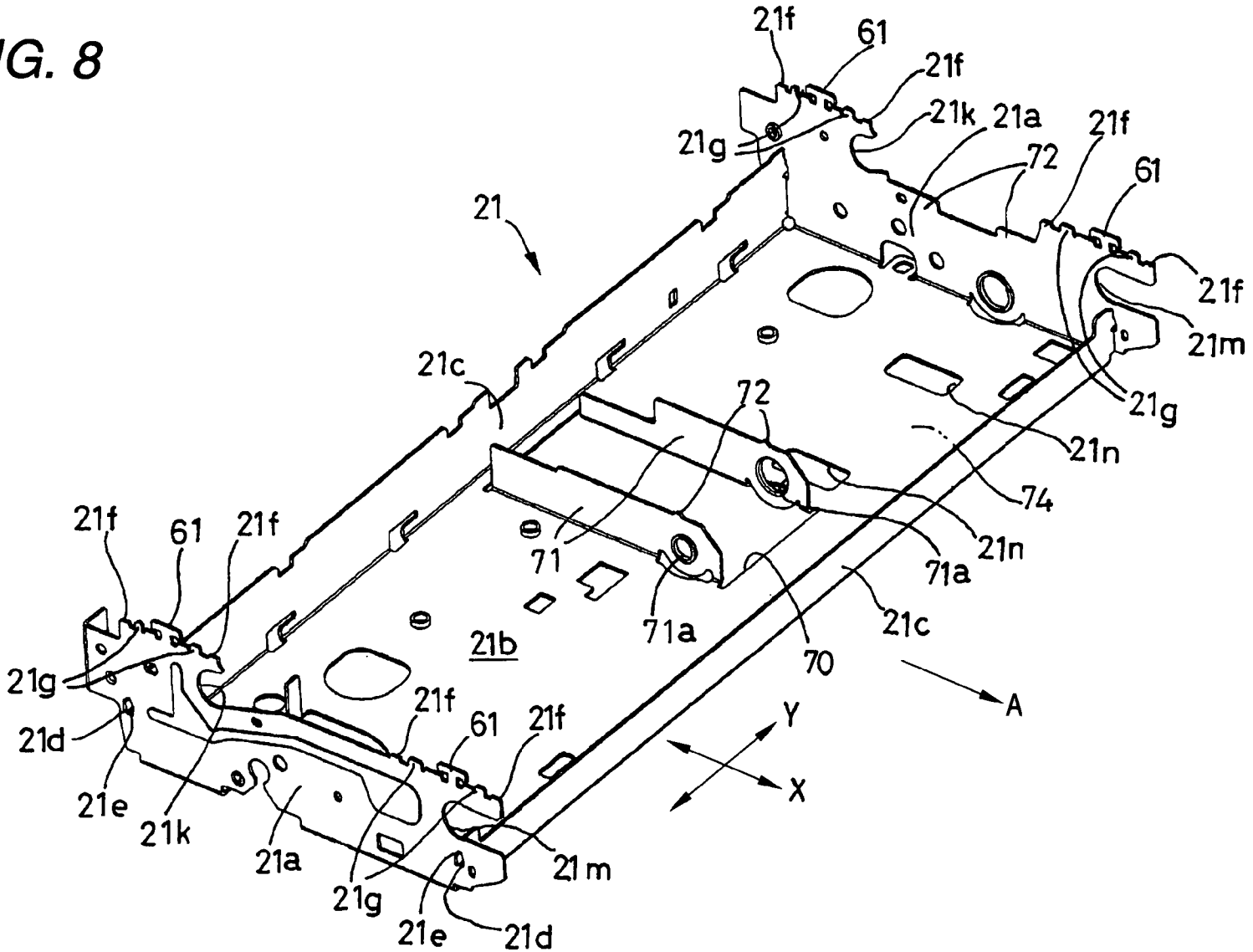
FIG. 8 is a perspective view of a main frame.
Figures 25A, 25B, 25C:
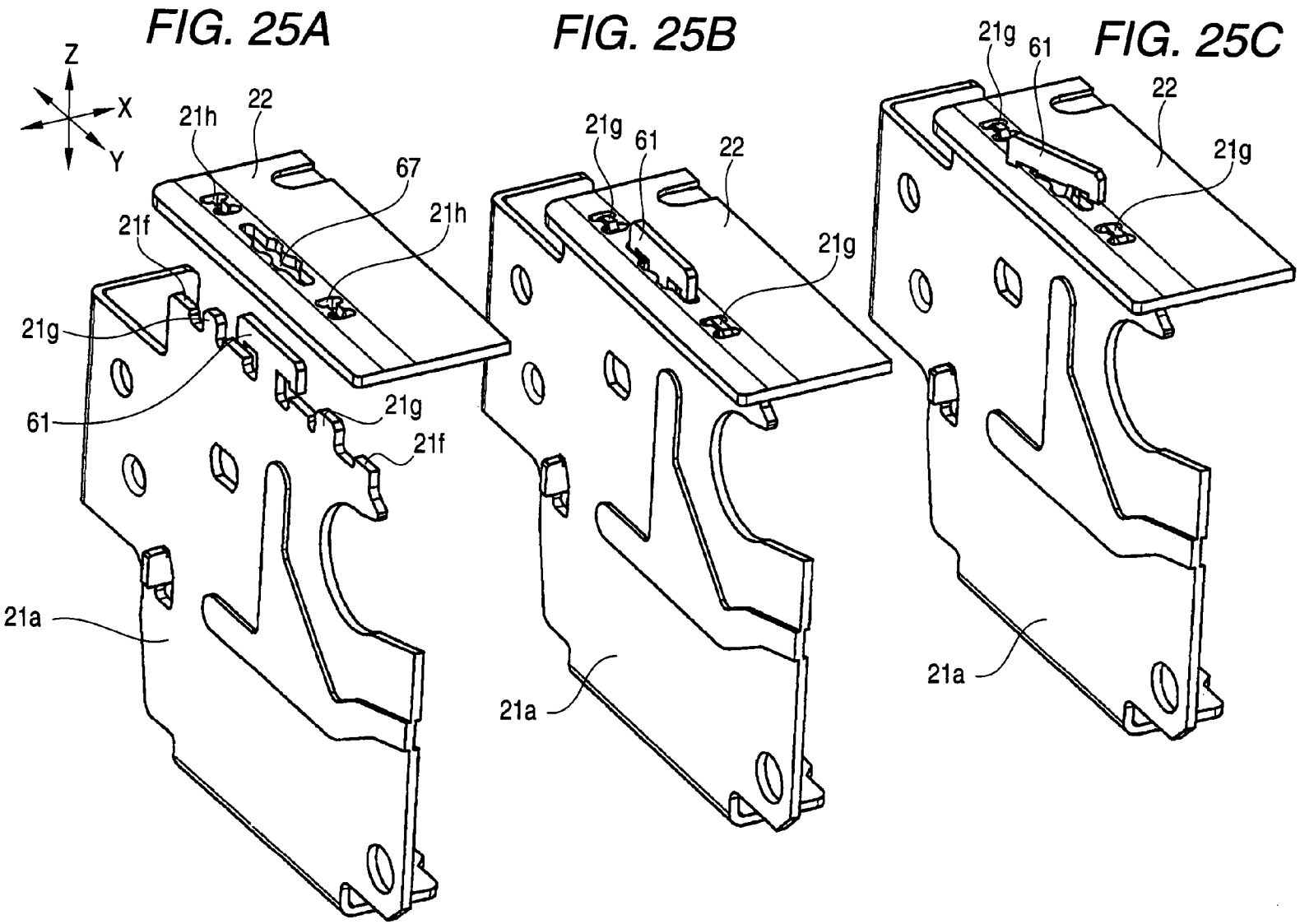
FIGS. 25A to 25C are enlarged perspective views showing attachment of the guide member to a side plate.

Next, with reference to FIGS. 8 to 11, a description will be given to a structure of the main frame 21 and an attachment structure of the guide member 22 (a first guide member) at the upstream side in the sheet transporting direction and the guide member 23 (a second guide member) at the downstream side. As shown in FIG. 8, the main frame 21 is such that after one metal plate (steel plate) is stamped into a specified shape, the pair of side plates 21*a* and a pair of reinforcement plates 21*c* are bent with respect to the bottom plate 21*b* to form a box shape having an open upper side. Accordingly, the assembling work becomes very simple. With respect to the pair of side plates 21*a* raised by bending both sides (both ends in the Y-axis direction) of the bottom plate 21*b* upward, projections 21*d* (only one side is shown in FIG. 8) of both ends of the pair of reinforcement plates 21*c* raised by bending both sides (both ends in the X-axis direction) of the bottom plate 21*b* are inserted in holes 21*e* of the side plates 21*a* (see FIGS. 9 and 10). Plural positioning convex parts 21*f* for horizontally supporting the lower surfaces of the horizontal plates of the first and the second guide members 22 and 23 and for regulating the height positions of the horizontal plates (besides height positions and levelness of first slide surfaces 51 and 52 described later), and T-shaped engagement pawls 61 are upward integrally formed at the upper end surfaces of the respective side plates 21*a* (see FIGS. 8, 25A). Since slit-shaped locking holes 67 in which the engagement pawls 61 can be inserted are provided in the horizontal plates of the first and the second guide members 22 and 23 (see FIGS. 12, 25A), after the respective engagement pawls 61 are fitted in the corresponding locking holes 67, the upper end side of each of the engagement pawls 61 is twisted leftward or rightward, so that crimping and fixing is performed to prevent coming-out in a state where the lower surface of the engagement pawl 61 is in contact with the upper surface of the horizontal plate (see FIGS. 9, 10 and 25C). As stated above, in the state where the engagement pawls 61 are fitted in the locking holes 67, when they are twisted or bent and the respective guide members 22 and 23 are fixed to the main frame 21, the assembling work is very simple, and the number of parts does not increase.

Incidentally, at this time, a pair of protrusions 21*g* (see FIGS. 8, 25A) protruding at both sides of the engagement pawl 61 on the upper end surface of each of the side plates 21*a* are fitted in positioning holes 21*h* (see FIG. 25B) adjacent to the locking hole 67, so that the parallelism of the first and the second guide members 22 and 23 and the interval in a direction orthogonal to the parallel are regulated. By adopting the structure as stated above, the assembling structure itself of the main frame 21 and the two guide members 22 and 23 become a box shape and the rigidity becomes high.

The carriage 5 on which the recording head 4 is mounted is slidably supported (mounted) to extend over the guide member 22 at the upstream side in the sheet transporting direction and the guide member 23 at the downstream side and can reciprocate. The first slide surfaces 51 and 52 that function as horizontal guide parts parallel to the lower surface (head surface on which the nozzle is formed) of the recording head 4 in the carriage 5 are formed at the sides, close to the carriage 5, of the upper surfaces of both the guide members 22 and 23.

A second slide surface 54 directed toward the downstream side of the sheet transportation is formed (see FIGS. 9, 11 and 12) on an almost perpendicular (vertical) guide piece 53 obtained by bending the upstream side, in the sheet transporting direction, of the downstream side guide member 23.

Figure 9:
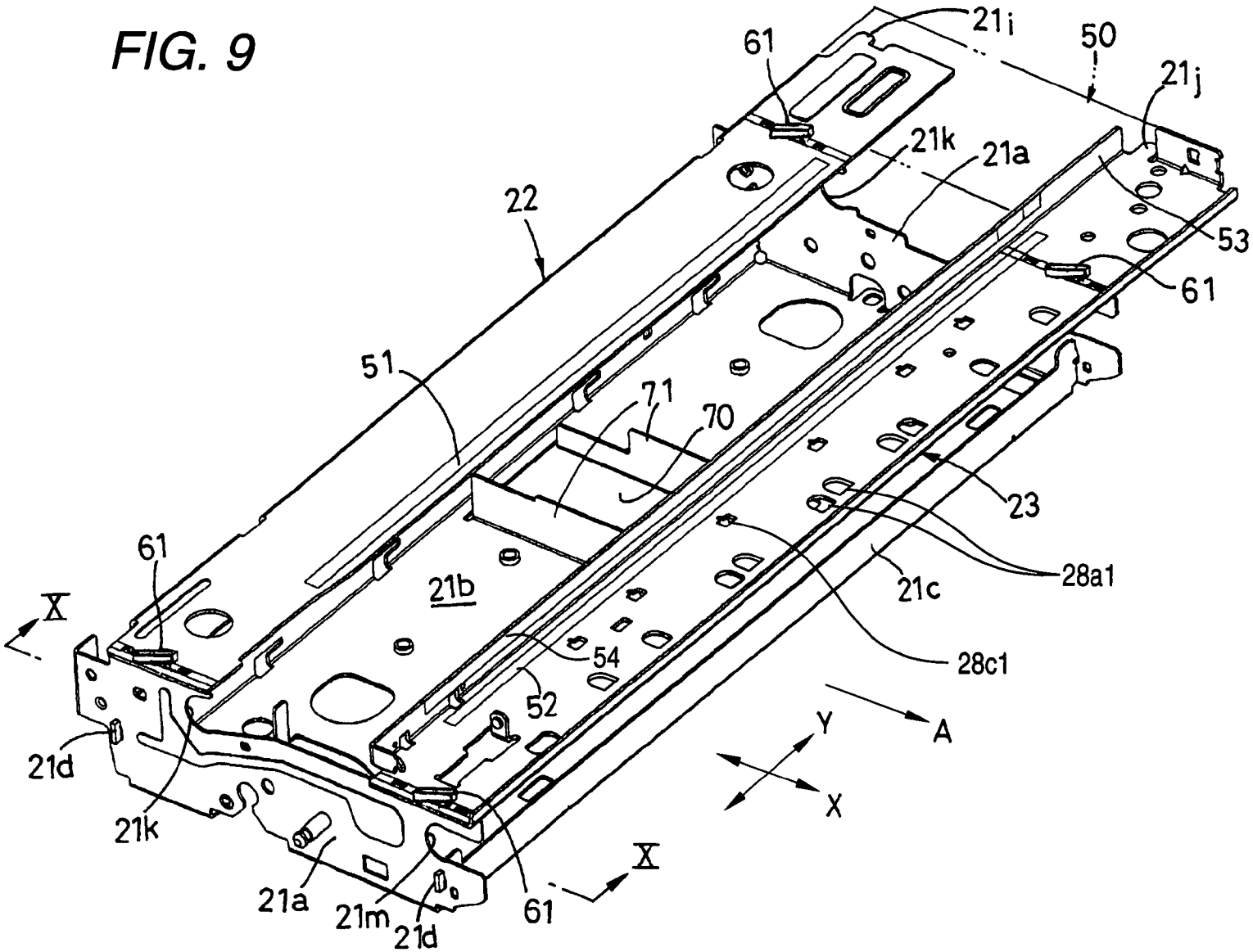
FIG. 9 is a perspective view of a state in which two guide members are fitted to the main frame.
Figure 10:
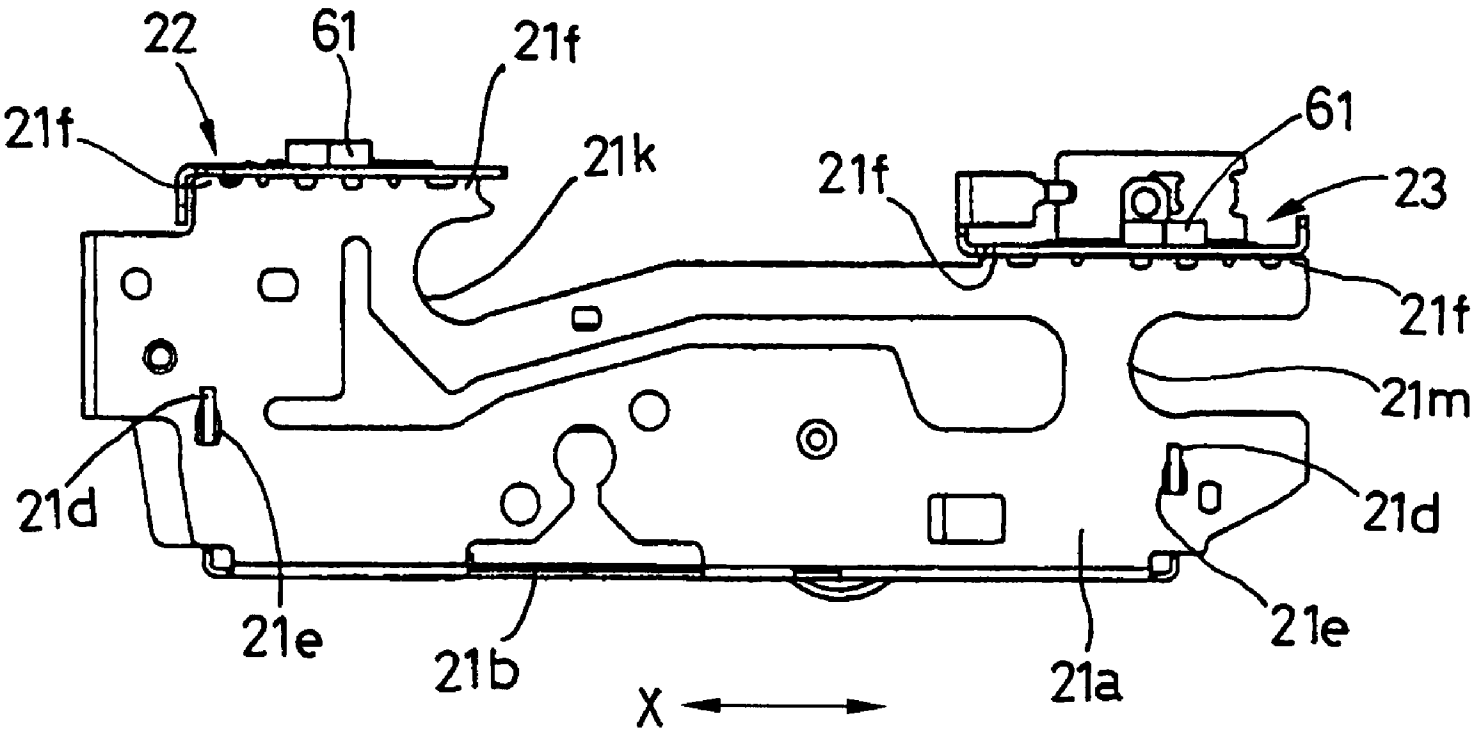
FIG. 10 is a side view taken along line X-X of FIG. 9.
Figure 11:
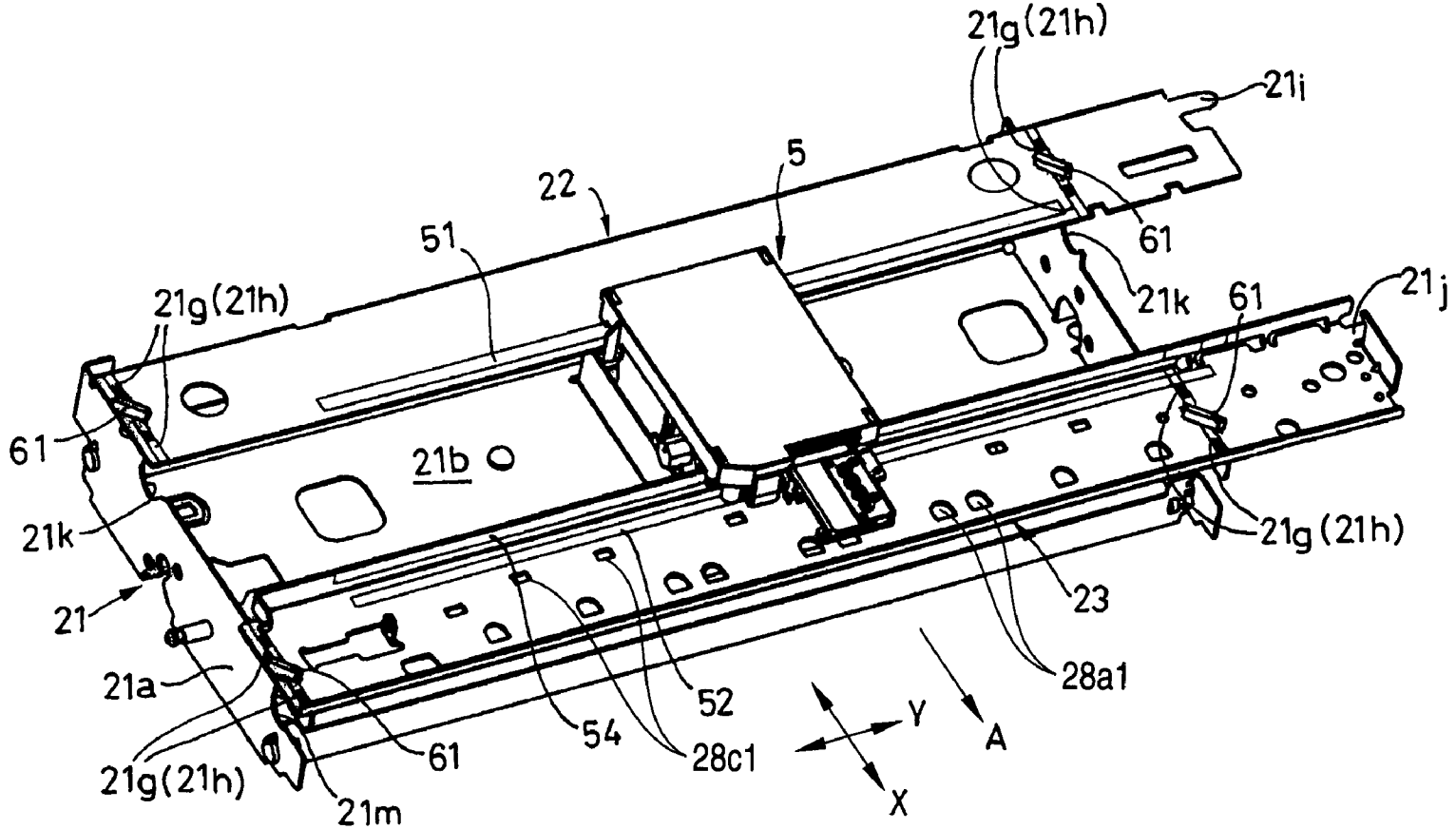
FIG. 11 is a perspective view of a state in which a carriage is mounted.
Figure 13:
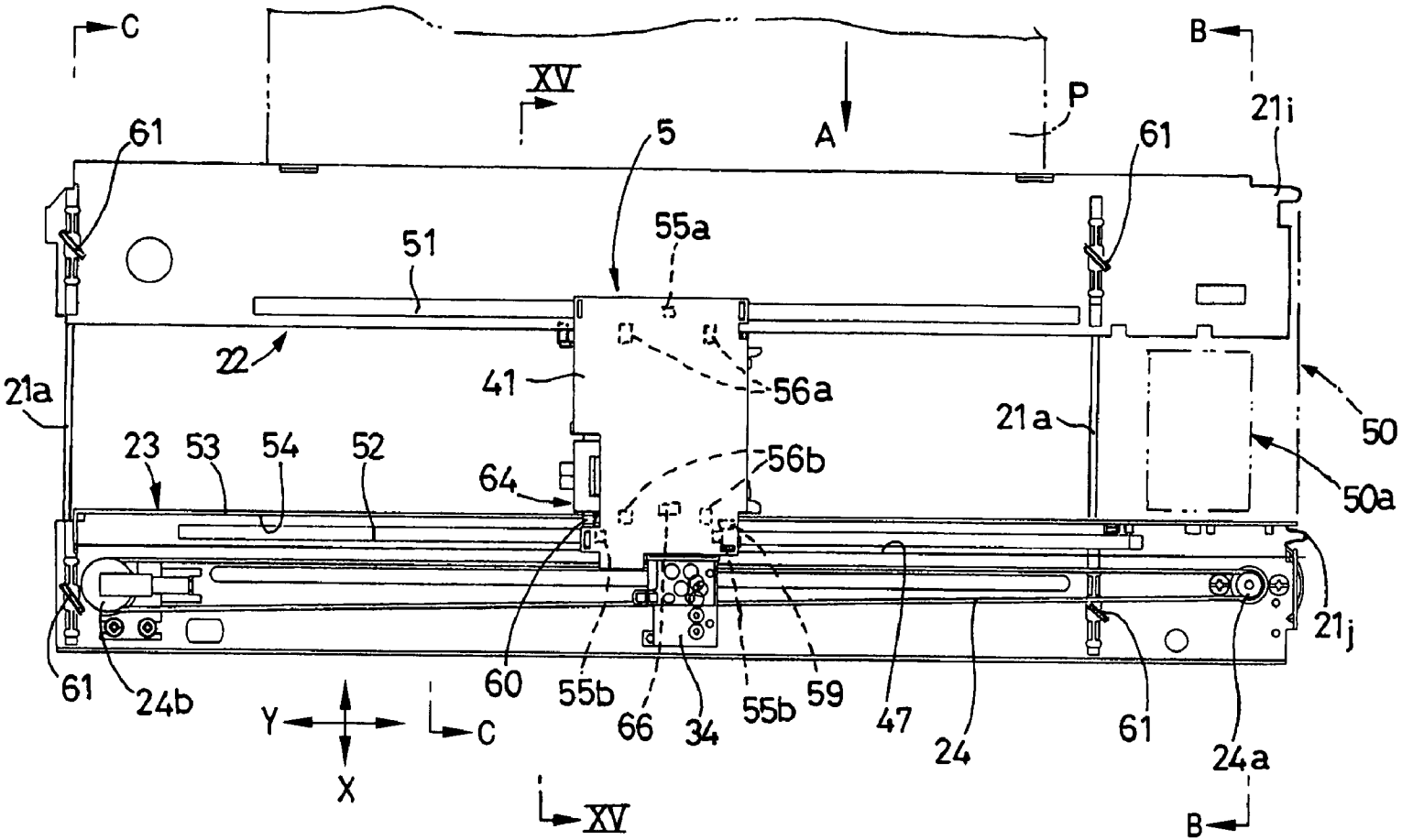
FIG. 13 is a plan view of the carriage and the pair of guide members.
Figure 14:
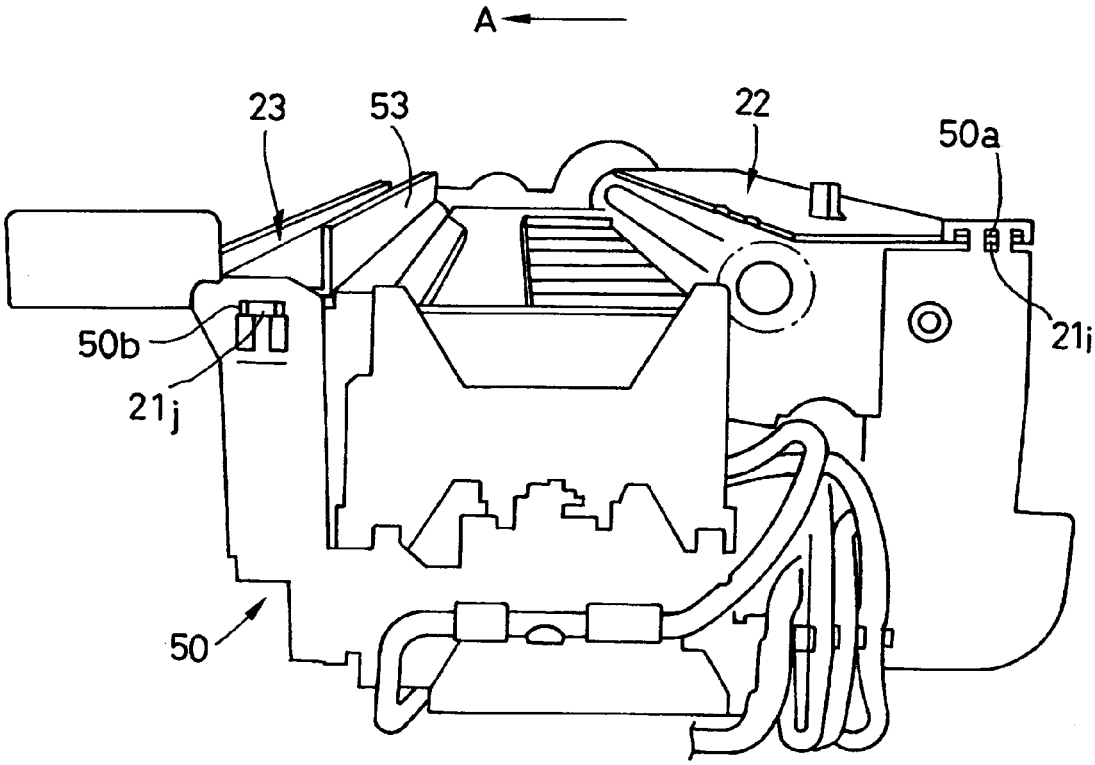
FIG. 14 is a side view showing an attachment part of a maintenance unit.

Incidentally, as shown in FIGS. 9, 11 and 13, the right ends of the first and the second guide members 22 and 23 protrude toward the right direction from the right side plate 21*a*, and the maintenance unit 50 is mounted to extend over the protruding place and the right side plate 21*a*. In order to attach the maintenance unit 50, tongue pieces 21*i* and 21*j* as attachment parts are made to protrude rightward at the right end parts of the horizontal plates of the first and the second guide members 22 and 23, and these tongue pieces 21*i* and 21*j* are inserted in the horizontal direction into engagement holes 50*a* and 50*b* of the maintenance unit 50 and are fitted to perform positioning (see FIG. 14).

Further, an opening part 70 capable of housing the paper feed arm 6*a* and the paper feed roller 6*b* of the paper feed unit 6 is formed in the bottom plate 21*b* of the main frame 21. A pair of shaft support plates 71 are provided to stand at both right and left sides of the opening part 70 by cutting and raising upward, and shaft holes 71*a* in which the base end part of the paper feed arm 6*a* can be rotatably supported are provided in both the shaft support plates 71 (see FIGS. 8 and 9). Besides, in order to regulate and set the height position of the flat platen 26 extending in the Y-axis direction to face the lower surface of the recording head 4 in the carriage 5, protrusions 72 are respectively provided in the upper ends of the pair of shaft support plates 71 and the one side plate 21*a* (the right side plate 21*a* in FIG. 8). By this, a gap between the upper surface of the platen 26 mounted to the main frame 21 and the lower surface of the recording head 4 (gap through which the sheet P can pass) can be accurately regulated.

The carriage 5 includes first slide convex parts 55*a* and 55*b* which protrude from the lower surface side and come in contact with the first slide surfaces 51 and 52 of both the guide members 22 and 23, and plural coming-out preventing pawls 56*a* and 56*b* disposed to hold the first and the second guide members 22 and 23 in cooperation with the first slide convex parts 55*a* and 55*b*.

In this embodiment, the one first slide convex part 55*a* coming in contact with the first slide surface 51 of the first guide member 22 is disposed almost at the center of the carriage 5 in the horizontal direction (main scanning direction). The two first slide convex parts 55*b* coming in contact with the first slide surface 52 of the second guide member 23 and disposed at a suitable distance from each other in the horizontal direction (main scanning direction), and the two right and left coming-out preventing pawls 56*a* and 56*b* opposite to the lower surface of each of the first and the second guide members 22 and 23 are respectively provided at the sides close to both the right and left side pieces of the carriage 5 when viewed on a plane (see FIG. 13).

The three first slide convex parts 55*a*, 55*b* and 55*b* are disposed at the respective apexes of a triangle (isosceles triangle is preferable) of the carriage 5 when viewed on a plane, so that the carriage 5 is stably supported relative to the first and the second guide members 22 and 23. In order to lightly slide the first slide convex parts 55*a* and 55*b* while receiving the weight of the carriage 5 to both the guide members 22 and 23, in the lower surfaces (support surfaces, slide surfaces) of the first slide convex parts 55*a* and 55*b*, plural recesses (not shown) long in the X-axis direction and for holding lubricating grease are formed in the main scanning direction (Y-axis direction) at suitable intervals.

Figure 15:
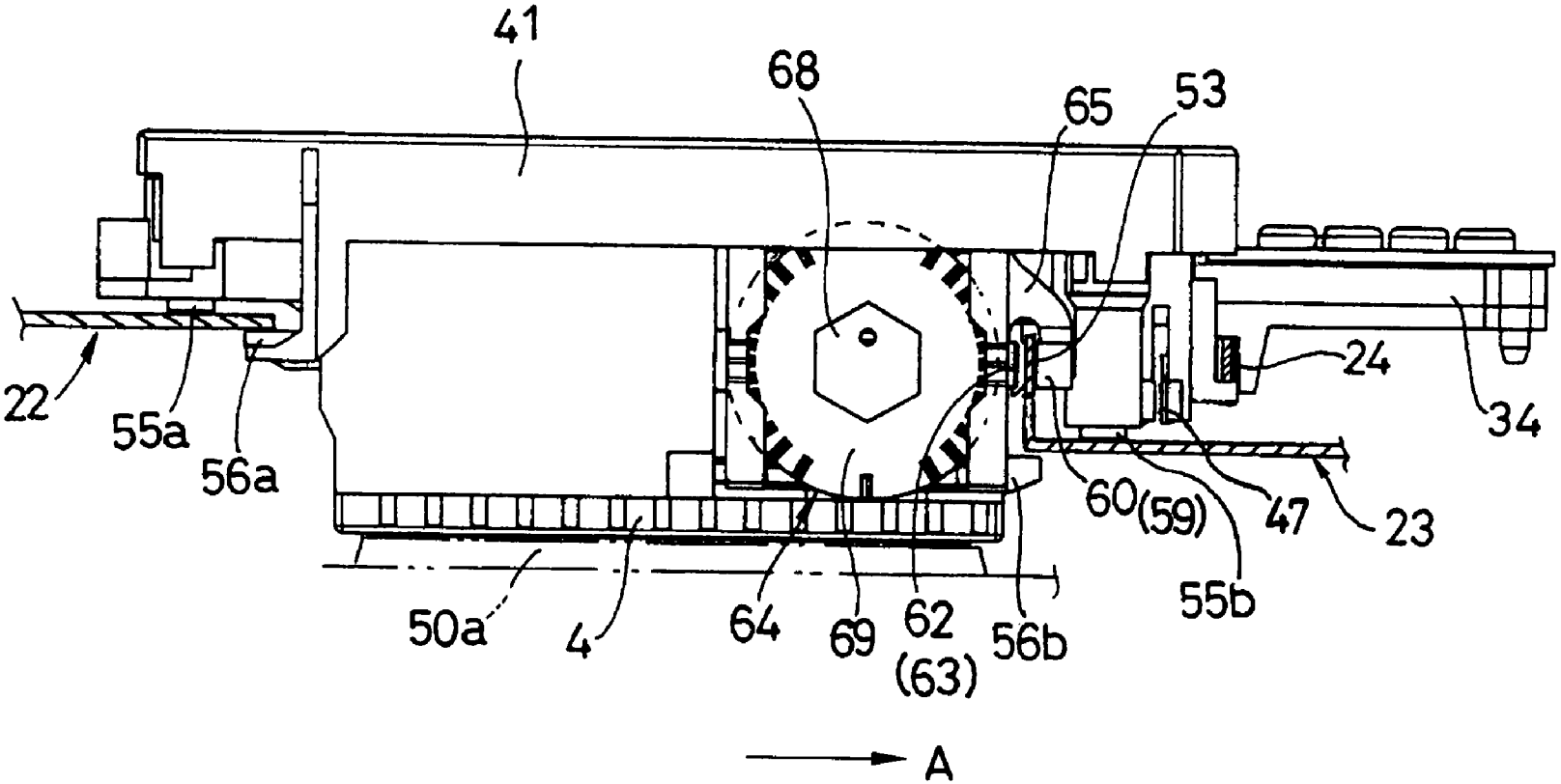
FIG. 15 is an enlarged side sectional view taken along line XV-XV of FIG. 13.
Figure 16:
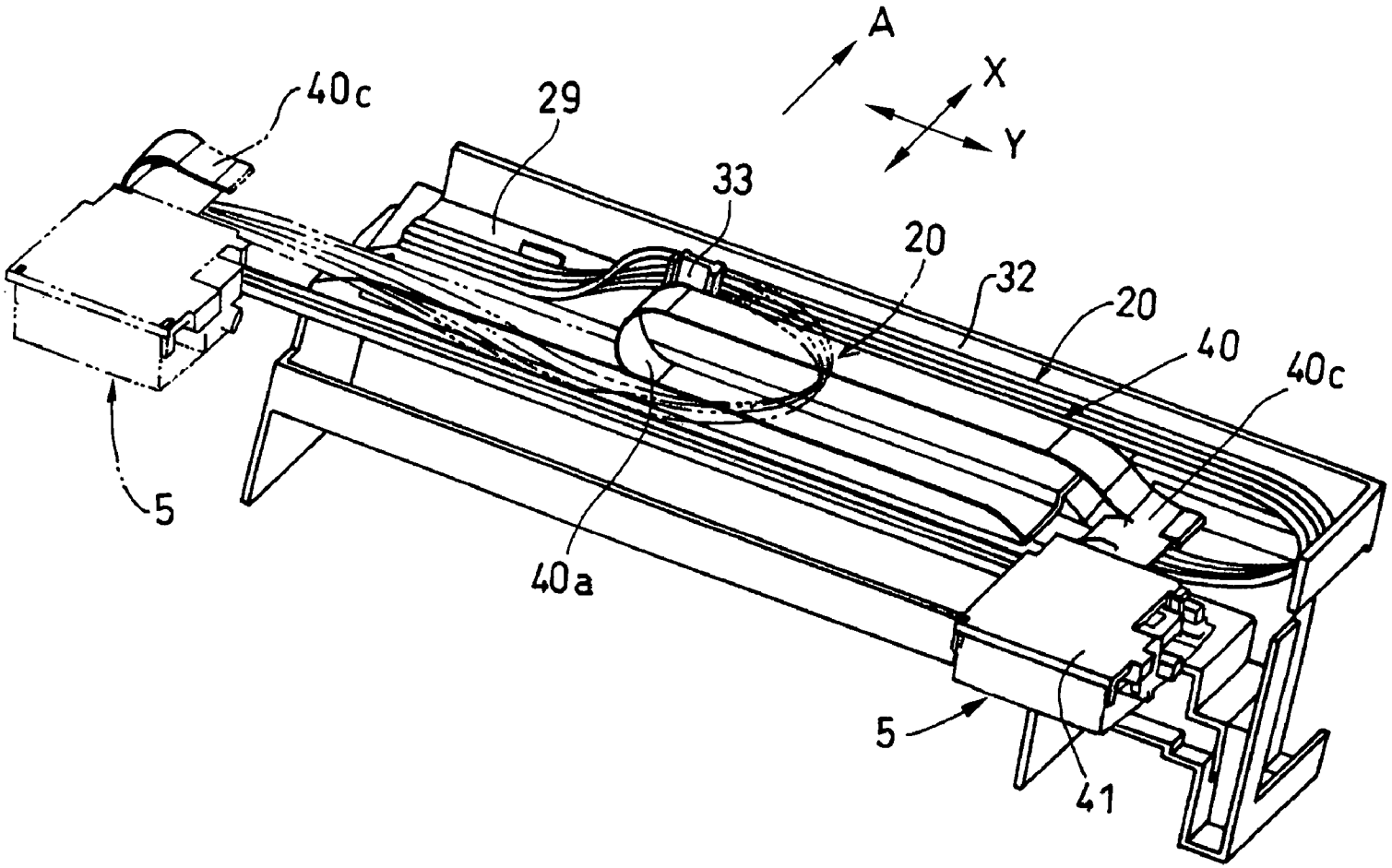
FIG. 16 is a perspective view showing the arrangement of an ink supply tube and a flexible flat cable with respect to the carriage.

The carriage 5 is provided with two second slide convex parts 59 and 60 coming in contact with the second slide surface 54 of the second guide member 23. The one second slide convex part 59 is formed integrally with the holder case of the carriage 5, is disposed to hold the vertical guide piece 53 between a holding piece 62 and the second slide convex part 59, and a portion between the holding piece 62 and the second slide convex part 59 is opened in the main scanning direction and downward (see FIGS. 13 and 15).

The other second slide convex part 60 and the holding piece 63 are provided through a posture adjusting unit 64 to adjust the mounting posture of the carriage 5 with respect to the vertical guide piece 53 of the second guide member 23. An adjustment block 65 is moved in the X-axis direction according to an adjustment knob 68 and a rotation position of a dial plate 69, and the protrusion amount of the second slide convex part 60 with respect to the guide piece 53 can be adjusted. The posture of the carriage 5 when viewed on a plane can be changed and adjusted around a place where the slide surface of the one first slide convex part 59 is in contact with the guide piece 53.

An urging unit 66 to always press and urge the vertical guide piece 53 of the second guide member to the slide surfaces of the pair of second slide convex parts 59 and 60 is provided between the pair of second slide convex parts 59 and 69 in the Y-axis direction (see FIG. 13).

Figure 12:
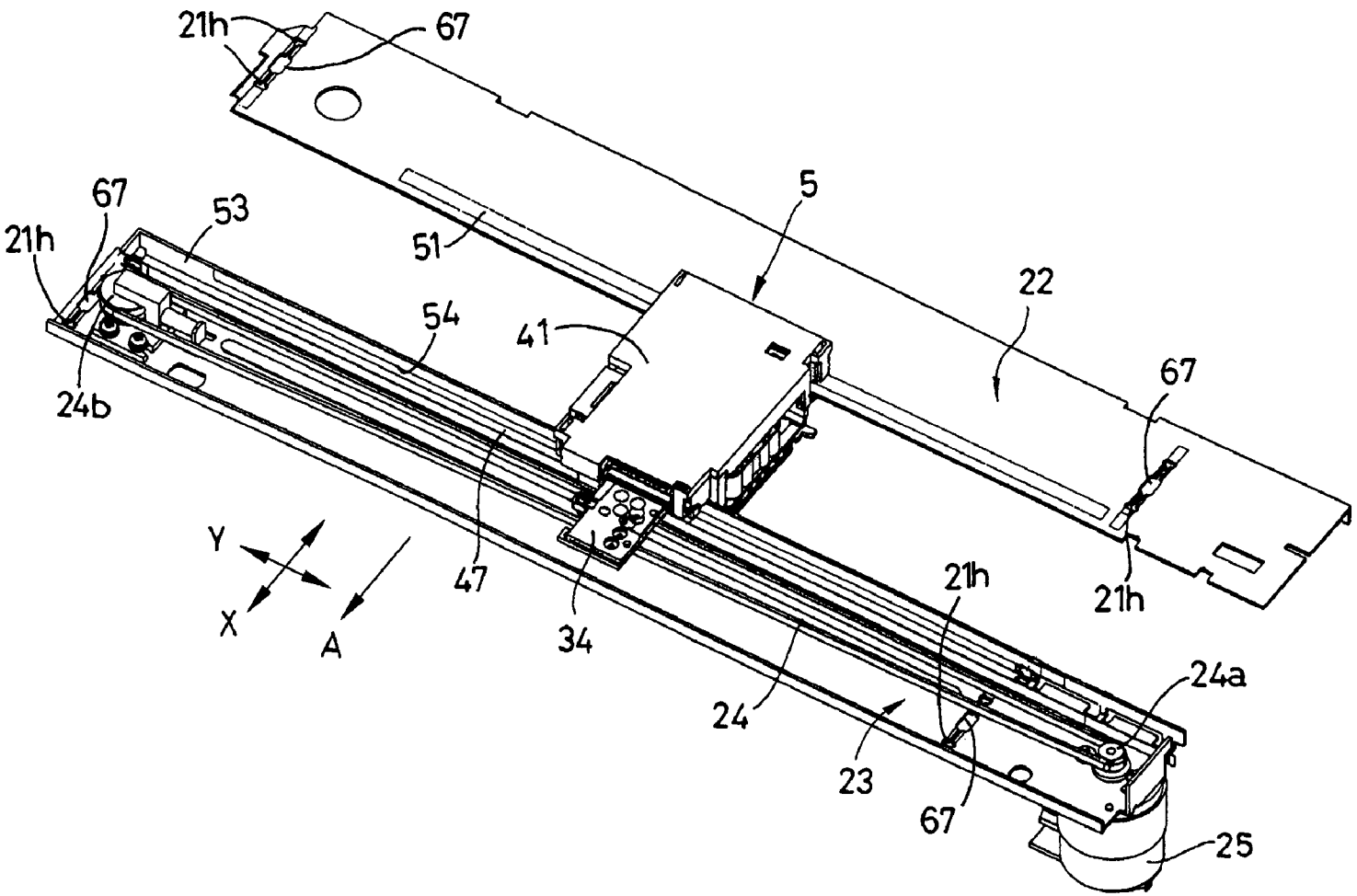
FIG. 12 is a perspective view of the carriage and a pair of guide members.

In order to reciprocate the carriage 5 on which the recording head 4 is mounted, on the upper surface of the guide member 23 disposed at the downstream side in the sheet transporting direction (direction of the arrow A), a timing belt 24 disposed to extend in the main scanning direction (Y-axis direction) is wound around pulleys 24*a* and 24*b*, and a CR (carriage) motor 25 (although a DC motor is used in the embodiment, another motor such as a stepping motor may be used) to drive the timing belt 24 is fixed to the lower surface of the second guide member 23 (see FIG. 12). The second guide member 23 includes an encoder strip 47 which is disposed in the vicinity of the guide piece 53 so as to extend in the main scanning direction and is for detecting the position of the carriage 5 in the Y-axis direction (main scanning direction). The belt-like encoder strip 47 is disposed so that a check surface (formation surface of slits disposed at regular intervals in the Y-axis direction) extends in the vertical direction.

Shaft support parts (attachment parts) 21*k* for both ends of a registration roller (transportation roller) pair 27 which are disposed at both sides of the platen 26 and at the upstream side in the transportation direction and is for transporting the sheet P to the lower surface of the recording head 4, and shaft support parts (attachment parts) 21*m* for both ends of a paper discharge roller 28 which is disposed at the downstream side of the platen 26 and is for transporting the recorded sheet P to the paper discharge part 10 are cut and formed in the pair of side plates 21*a* of the main frame 21 (see FIGS. 8 to 11). By adopting the structure as stated above, both axial lines of the registration roller 27 and the paper discharge roller 28 are horizontal and the attachment positions can be accurately regulated.

Figure 7:
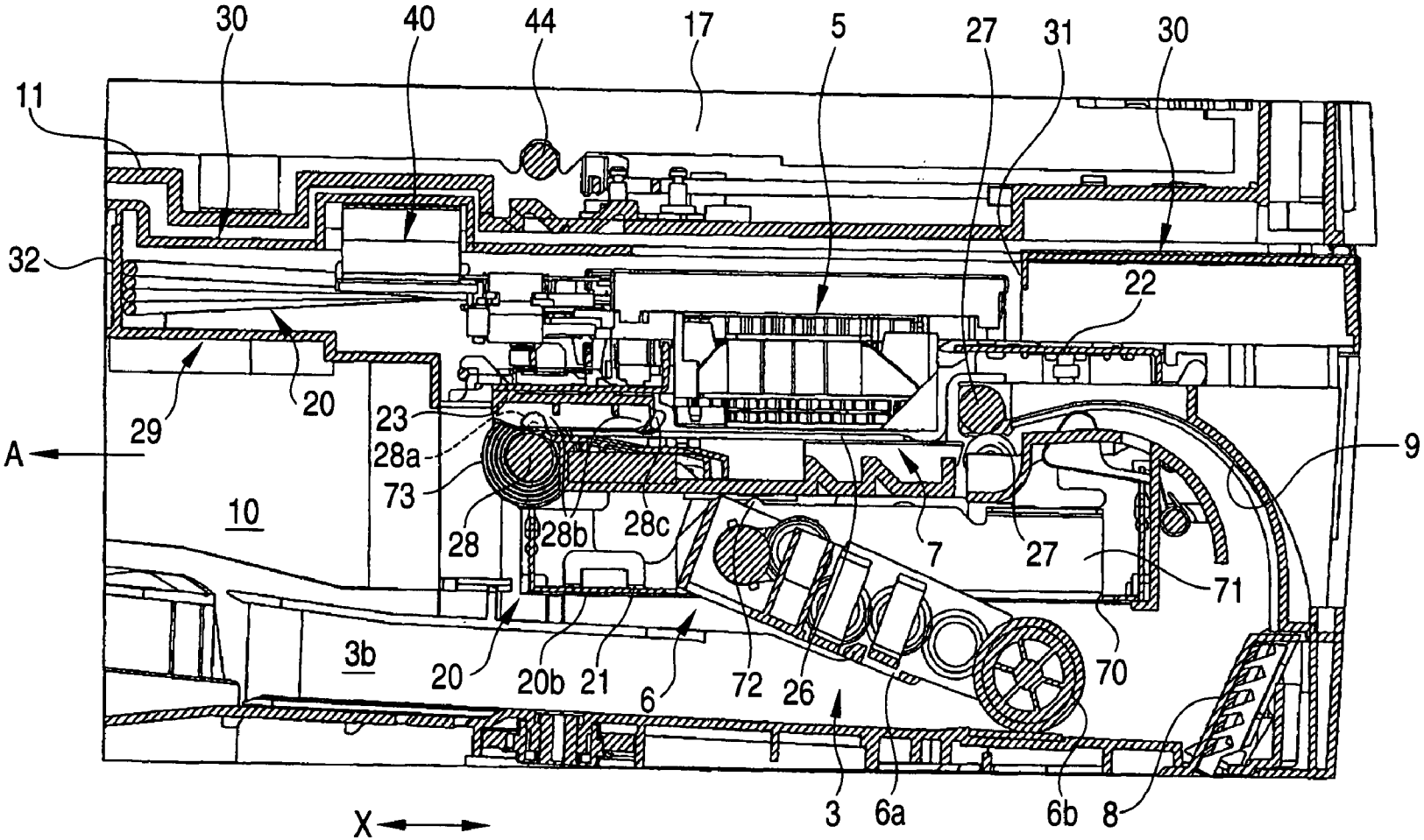
FIG. 7 is an enlarged side sectional view taken along line VII-VII of FIG. 4.
Figure 18:
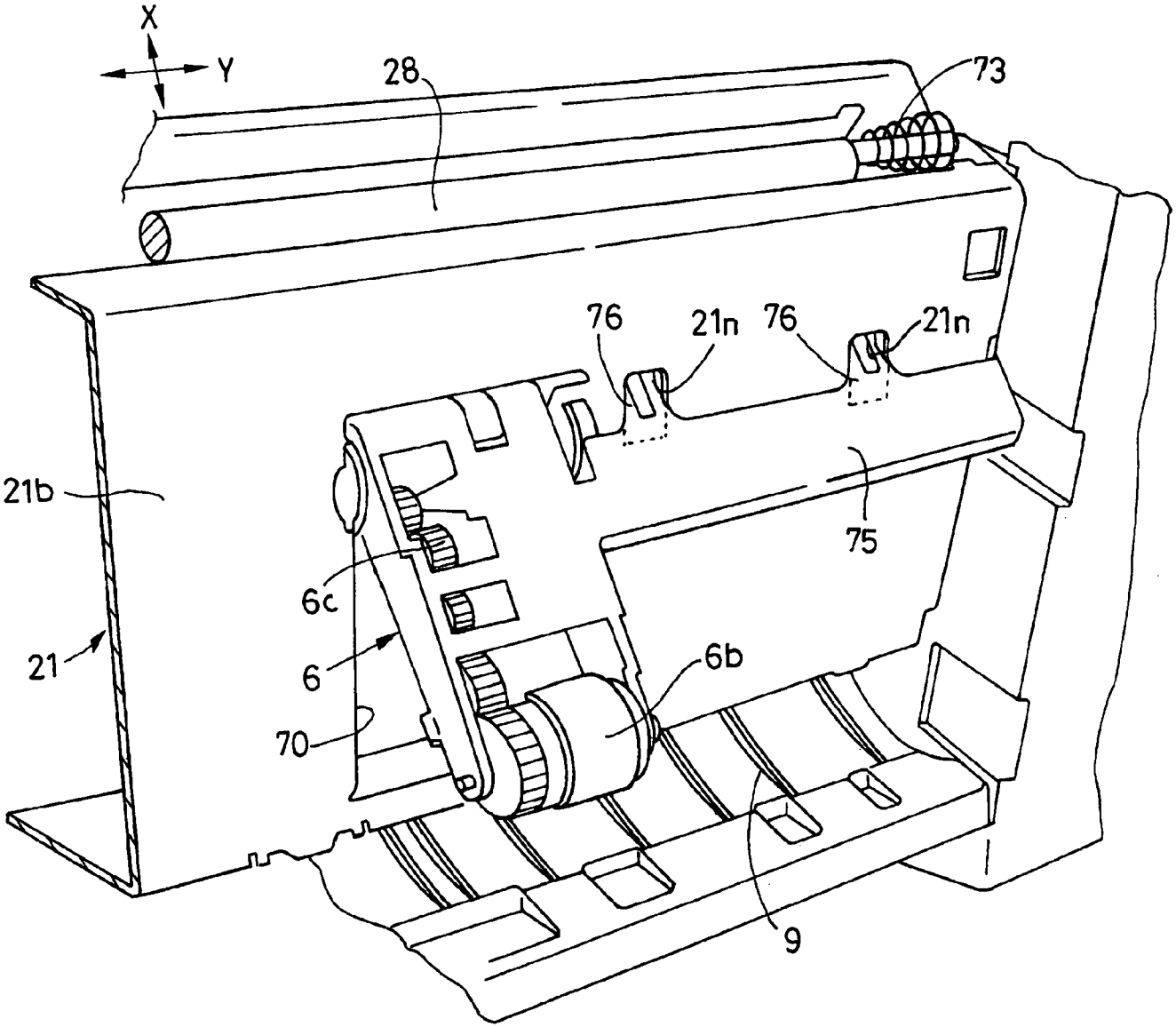
FIG. 18 is a perspective view of a state in which a paper feed arm is exposed from a main frame.
Figure 22:
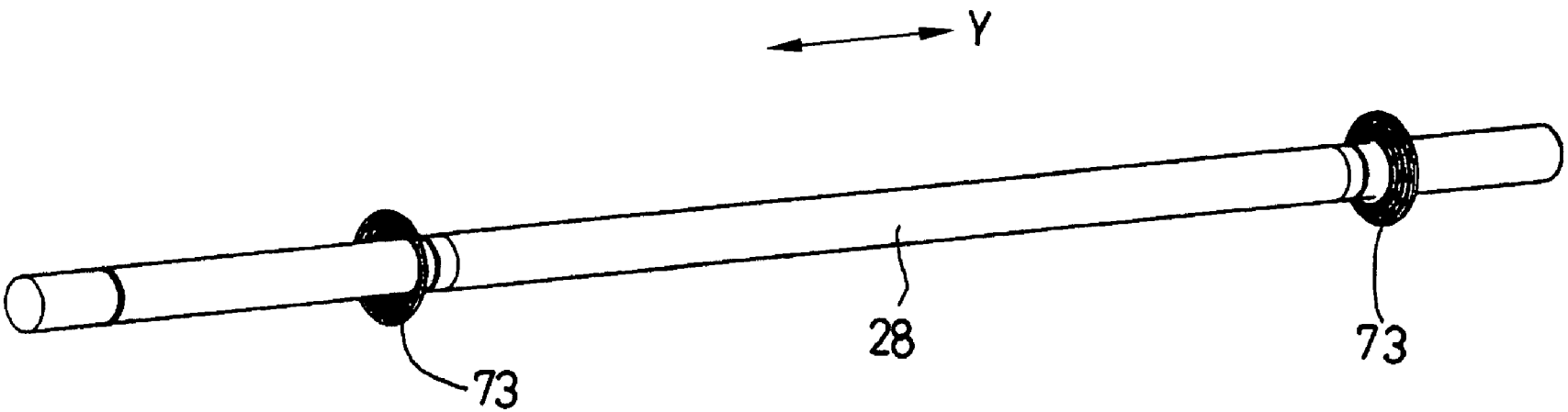
FIG. 22 is a perspective view showing a paper discharge roller and a guidance body.

As shown in FIG. 22, guidance bodies 73 each obtained by winding a thin line into a truncated conical shape such that a winding diameter gradually becomes small toward the center in the width of the sheet P are provided at both end parts of the paper discharge roller 28 (FIGS. 7 and 18 show only one of them). On the other hand, at the center side in the width of the sheet P with respect to the arrangement positions of the guidance bodies 73, spur rollers 28*a* coming in contact with the upper surface of the sheet P is disposed above the paper discharge roller 28. By this, when the recorded sheet P passes through between the spur rollers 28*a* and the paper discharge roller 28 and is discharged, both side edges of the sheet P extending in the X-axis direction are curved upward by the pair of guidance bodies 73. Accordingly, since the sheet P is discharged in a substantially U-shaped form, the sheet P does not droop down, and is straightly transported in the transporting direction (direction of the arrow A), and then, when coming off the paper discharge roller 28, the sheet drops onto the paper discharge part 10 and is stacked. By adopting the structure as stated above, it is possible to get time for ink of the previously recorded sheet P to dry.

Figure 17:
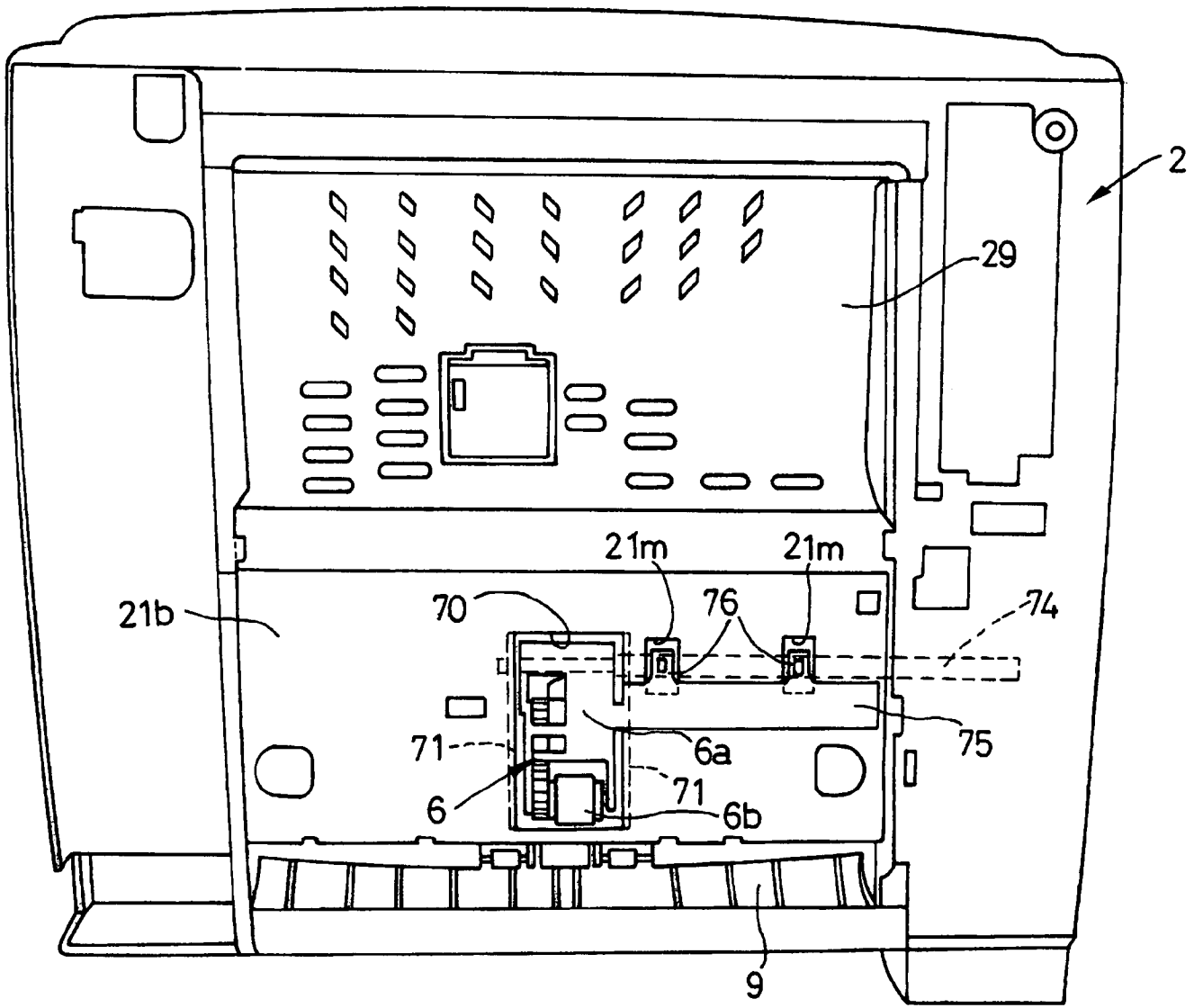
FIG. 17 is a bottom view of a housing.

A partition plate (lower cover body) 29 made of synthetic resin, which covers an upper part of the discharge part 10 at almost the same height as the bottom plate 21*b* of the main frame 21 and between the lower surface of the guide member 23 at the downstream side in the sheet transporting direction and the paper discharge port 10*a* at the front end of the housing 2, is formed integrally with the housing 2 (FIGS. 7 and 17).

Further, an upper cover body 30 is disposed above this partition plate (lower cover body) 29 at a suitable distance therefrom and to cover an upper part of the carriage 5 and its reciprocal movement passage. A rectangular window hole 31 through which the reciprocal movement passage of the carriage 5 can be seen from above is provided at the middle part of the upper cover body 30 (see FIG. 3). In the case where the sheet P causes a paper jam in the recording part 7, the user swings the image reading device 12 from the housing 2 and can remove the sheet P through this window hole 31. In this case, since the ink supply tube 20 is not routed on the platen 26, the removal of the sheet P becomes easy.

In addition, as shown in FIG. 7, there are also provided the spur rollers 28*a* and the paper discharging roller 28 for discharging the recording sheet on which the image is formed on the downstream side of the recording part 7 in the direction of transportation of the recording sheet, and the spur rollers 28*a* and the discharging roller 28 constitute a pair of discharging rollers. The paper discharging roller 28 is rotated by a rotating force of, for example, a stepping motor, and the recording sheet is discharged in a direction orthogonal to the width of the recording sheet (in the sub-scanning direction) by the rotation of the paper discharging roller 28.

Each of the spur rollers 28*a* has a plurality of teeth therearound, and is formed into a teethed roller in which the tips of the respective teeth are pointed into an acute angle so as to come into point contact with a recording surface of the recording sheet. The spur rollers 28*a* are urged toward the paper discharging roller 28, and comes into contact with the recording sheet when the recording sheet is discharged by the rotation of the paper discharging roller 28, and rotates in association with discharge of the recording sheet. Therefore, the paper discharging roller 28 serves as a driving roller.

Figure 23:
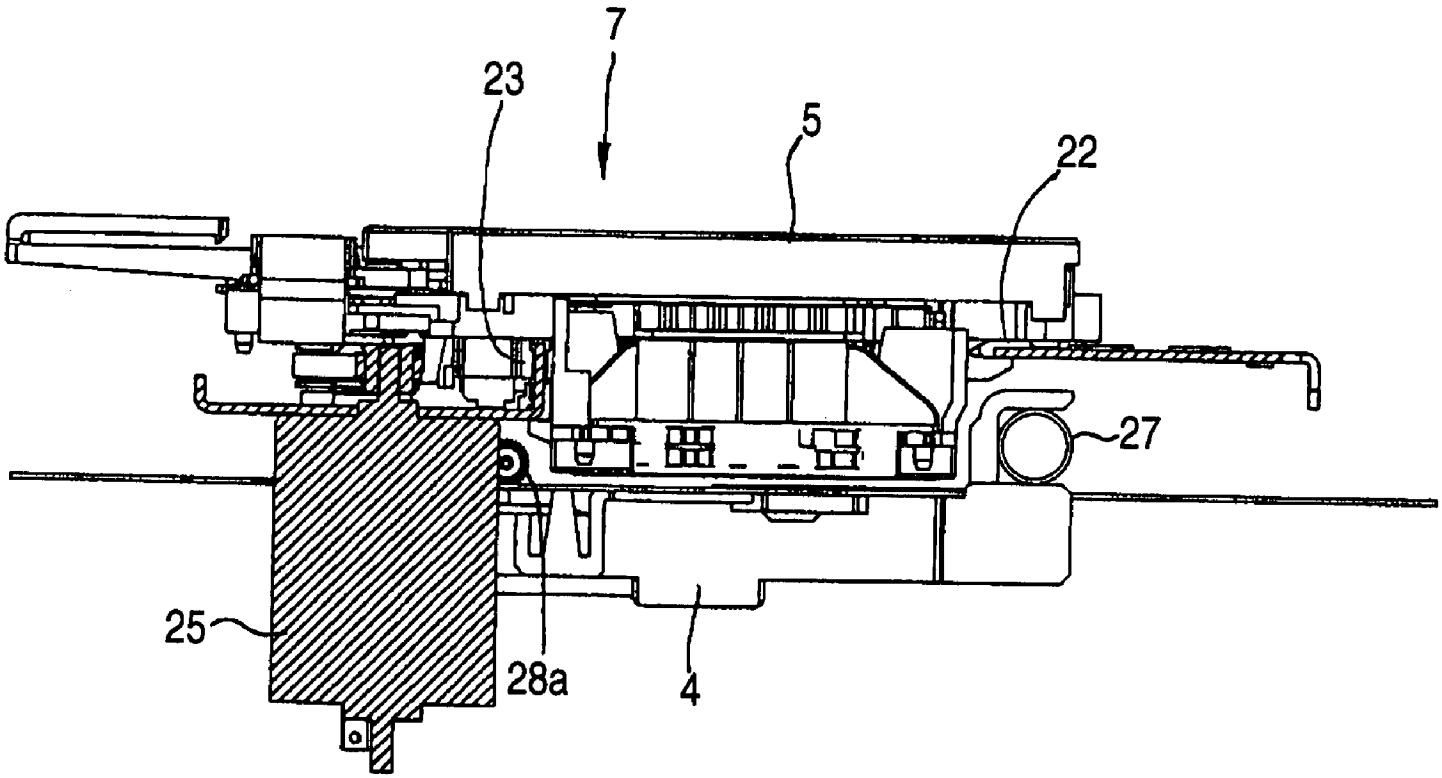
FIG. 23 is a side sectional view take along line B-B in FIG. 13.
Figure 24:
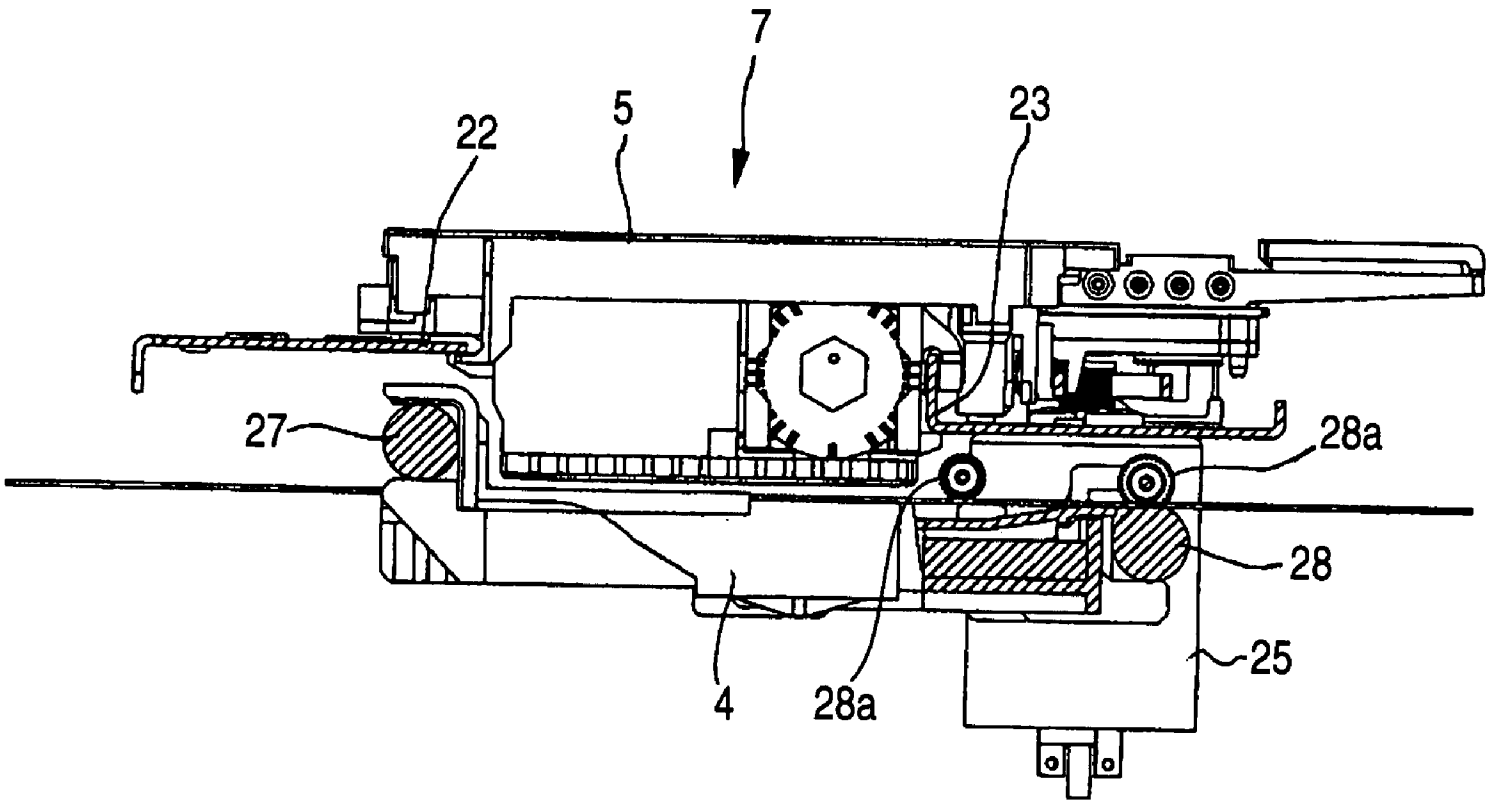
FIG. 24 is a side sectional view take along line C-C in FIG. 13.

Auxiliary spur rollers 28*c* are disposed on an upstream side of the spur rollers 28*a*. The auxiliary spur rollers 28*c* and the spur rollers 28*a* are held by holders 28*b*, respectively. These spur rollers 28*a* and the auxiliary spur rollers 28*c* are, as shown in FIGS. 23 and 24, provided on the second guide member 23. As can be seen in FIGS. 9 and 11, spur roller mounting holes 28*a*1 and auxiliary spur roller mounting holes 28*c*1 are formed in the second guide member 23. The spur roller mounting holes 28*a*1 and auxiliary spur roller mounting holes 28*c*1 do not overlap in the sheet transporting direction. In other words, the spur roller mounting holes 28*a*1 and auxiliary spur roller mounting holes 28*c*1 are formed at different positions in the main scanning direction.

According to this structure, since the auxiliary spur rollers 28*c* that are disposed adjacent to the recording part 7 press the recorded sheet at the upstream side of the spur rollers 28*a*, the deformation and float of the sheet is prevented and the sheet can be firmly transported.

In the related art, spur rollers are mounted to the guide member through spur roller holders and a side frame. In this embodiment, on the other hand, since the spur rollers 28*a* and the auxiliary spur rollers 28*c* are mounted to the second guide member only via the holders 28*b*, the structure is simplified and the mounting accuracy of those rollers is enhanced. Also, the auxiliary spur rollers 28*c* press the sheet at the upstream side. These improve the printing quality. Next, a relation between the paper feed unit 6 and the paper feed cassette 3 will be described. A drive shaft 74 made of synthetic resin shown in FIGS. 7, 17, 18 and 19 is rotatably supported in the shaft holes 71*a* respectively provided in the side plate 21*a* and the pair of shaft support plates 71 of the main frame 21 shown in FIG. 8. A tip end of this drive shaft 74 is inserted in the base part of the paper feed arm 6*a* of the paper feed unit 6 to protrude laterally, and the base end part of this paper feed arm 6*a* is disposed in the opening part 70 provided in the bottom plate 21*b*. Accordingly, the paper feed arm 6*a* and the drive shaft 74 are pivotally coaxially supported with respect to the shaft holes 71*a* of the pair of shaft support plates 71. The paper feed roller 6*b* is rotated by the rotation driving of the drive shaft 74 in a given direction through a gear transmission mechanism 6*c* provided in the paper feed arm 6*a*. Besides, the paper feed roller 6*b* side is always urged downward relatively to the bottom plate 21*b* by a not-shown urging unit (for example, a torsion spring).

A substantially flat-plate shaped cam follower member 75 parallel to the drive shaft 74 and integrally protruding from the paper feed arm 6*a* made of synthetic resin is disposed at the lower surface side of the bottom plate 21*b*, and extends to above an after-mentioned cam part 77 of the paper feed cassette 3. Bearing parts 76 integrally protruding from the cam follower member 75 are inserted through insertion holes 21*n* (see FIGS. 8, 17 and 18) provided in the bottom plate 21*b* to the upper surface of the bottom plate 21*b* and are fitted onto the drive shaft 74 relatively rotatably. Accordingly, in the state where most of the paper feed arm 6*a* and the paper feed roller 6*b* swung and raised is housed at the upper surface side through the opening part 70 of the bottom plate 21*b*, setting is made such that the cam follower member 75 becomes almost adjacent to the lower surface of the bottom plate 21*b* and becomes parallel thereto.

Figure 19:
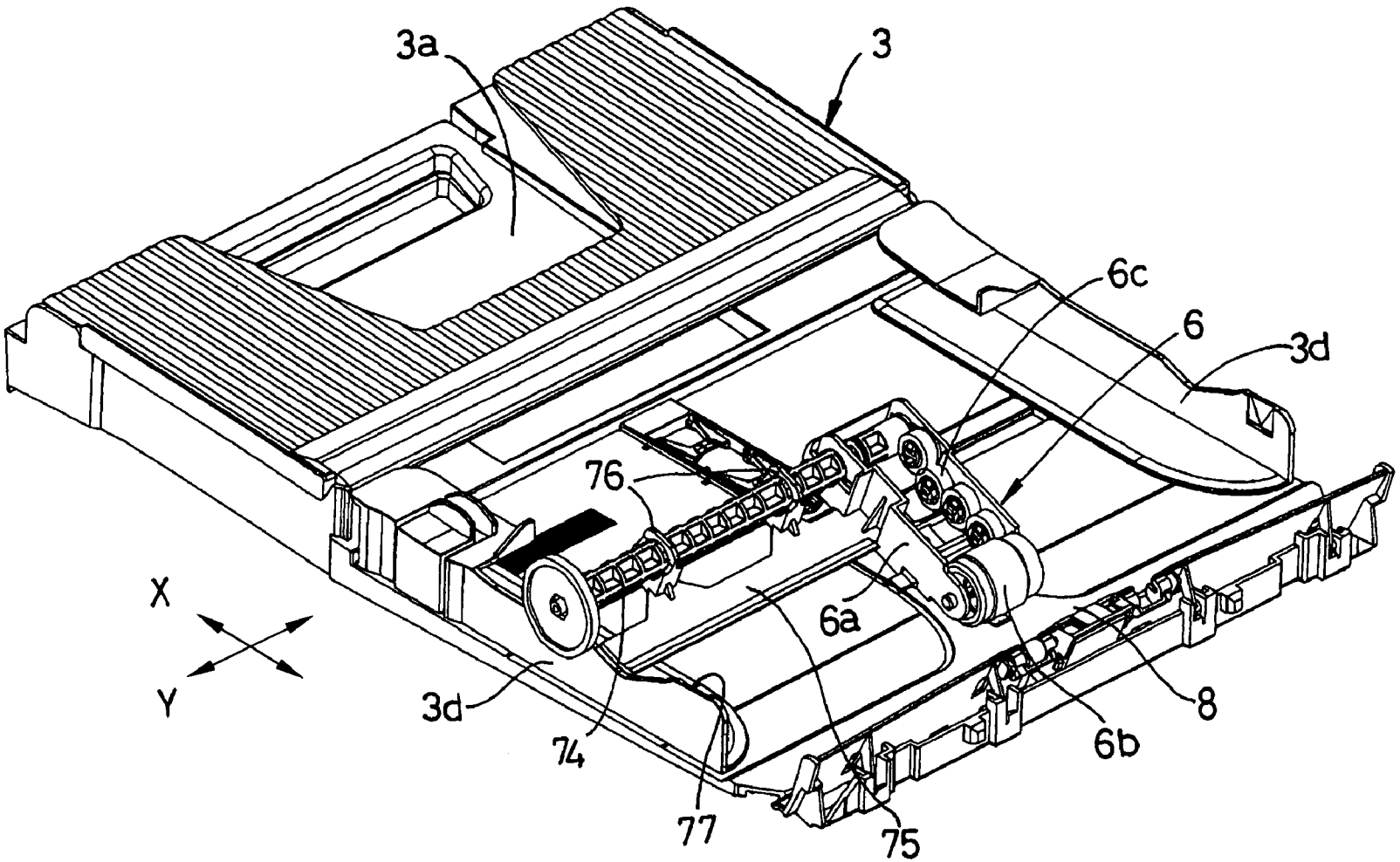
FIG. 19 is a perspective view of a paper feed cassette and a paper feed unit.
Figure 20:
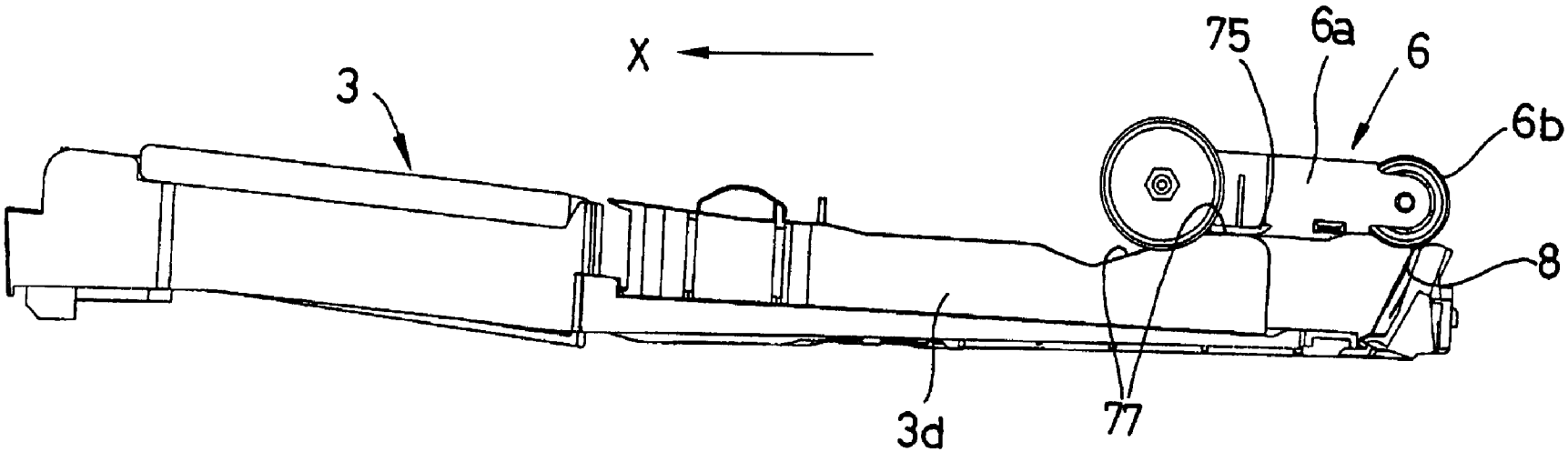
FIG. 20 is a side view showing a state in which a paper feed roller gets over a bank part of the paper feed cassette.
Figure 21A:
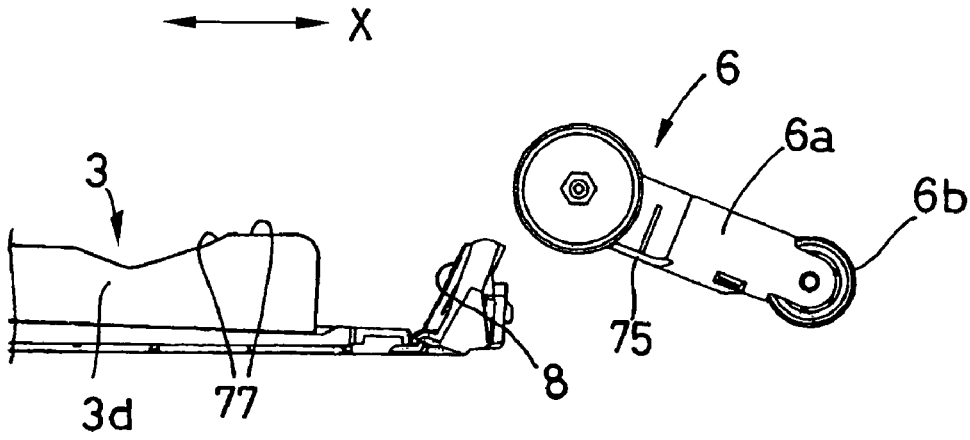
FIG. 21A is an explanatory view showing a state in which the paper feed roller is separate from the paper feed cassette.
Figure 21B:
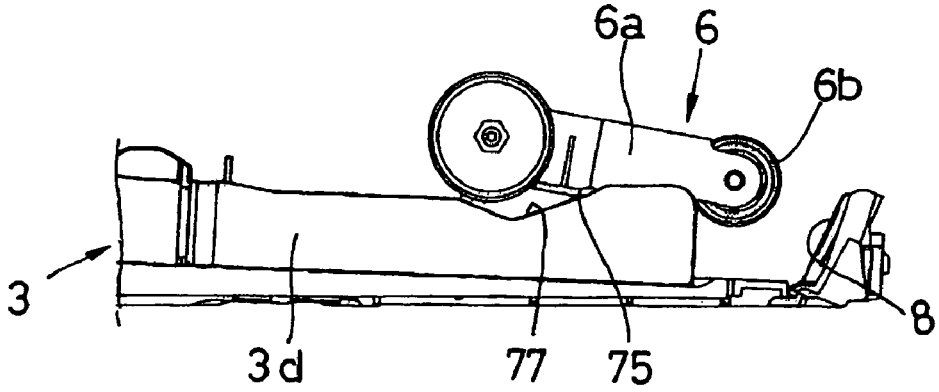
FIG. 21B is an explanatory view showing a state after the paper feed roller gets over the bank part of the paper feed cassette.
Figure 21C:
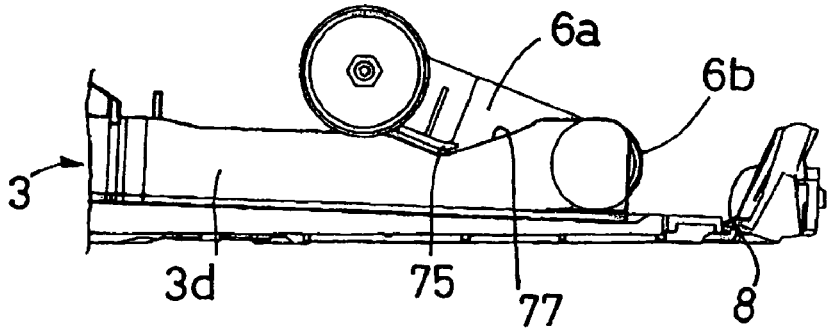
FIG. 21C is an explanatory view showing a state where the paper feed roller is located at the lowest position.

Cam parts 77 which come in slide contact with the cam follower 75 according to the advancing and retracting movement (movement in the X-axis direction) of the paper feed cassette 3 and are for integrally raising and lowering not only the paper feed arm 6*a* but also the paper feed roller 6*b*, are integrally formed on the upper end surfaces of both the right and left side plate parts 3*d* as both the end parts, in the Y-axis direction, of the synthesis resin paper feed cassette 3 at both sides of the housing part 3*b* of the sheet P (see FIGS. 19, 20 and 21).

According to the above structure, as shown in FIG. 21A, the paper feed cassette 3 is inserted through the opening part 2*a* of the front of the housing 2, and when the lower surface of the cam follower member 75 comes in contact with the start end side (side close to the bank part 8) of the cam part 77, in accordance with the advancing movement of the paper feed cassette 3, the cam follower member 75 is pressed up (see FIG. 20). Together with this, not only the paper feed arm 6*a* but also the paper feed roller 6*b* is swung upward, and the paper feed roller 6*b* and the paper feed arm 6*a* go over the bank part 8. In the state where the paper feed arm 6*a* and the paper feed roller 6*b* are raised, these members are housed in the space (in the main frame 21) above the bottom plate 21*b* through the opening part 70. Besides, at that time, the flat cam follower member 75 is also put in a state where it comes in contact with or is close to the lower surface of the bottom plate 21*b*. Accordingly, without increasing the height of the vertical space between the bottom plate 21*b* of the main frame 21 and the paper feed cassette 3, the vertical swing operation of the paper feed arm 6*a* and the paper feed roller 6*b* can be ensured. In other words, the height from the paper feed cassette 3 to the bottom plate 21*b* of the main frame 21 can be made low, the height size of the whole image recording apparatus 1 is made small, and a compact one can be provided.

When the cam follower member 75 goes over the highest position of the cam part 77 and is positioned at a descending part, according to that, not only the paper feed arm 6*a* urged downward but also the paper feed roller 6*b* is swung downward (see FIG. 21B). The paper feed roller 6*b* can come in contact with the uppermost layer of the sheet P stacked in the container part 3*b*.

When the paper feed cassette 3 is made to further advance to the innermost part in the housing 2 (setting state), and when one end (lower end) of the cam follower member 75 of the paper feed arm 6*a* in the downward state comes in contact with the lowermost height position of the cam part 77, the paper feed roller 6*b* can come in contact with the bottom part of the paper feed cassette 3 (see FIG. 21B).

As stated above, the paper feed unit 6 is provided with the cam follower member 75 positioned below the bottom plate 21*b* of the main frame 21, and the paper feed cassette 3 is provided with the cam part 77 which, together with the cam follower member 75, raises, lowers and swings the paper feed unit 6 at least temporarily according to the advancing and retreating movement of the paper feed cassette 3 in the housing 2 (main body case). Thus, the paper feed unit 6 can be raised and lowered according to the loading and unloading operation of the paper feed cassette 3, and the operation becomes simple.

In the embodiment illustrated in the drawings, the opening part 70 is provided in order to house the paper feed arm 6*a* and the paper feed roller 6*b* above the bottom plate 21*b* at the time when they are raised. However, a housing part recessed upward and opened downward may be bulged and formed in the bottom plate 21*b* by the press or the like. Similarly, in order that the most raised position of the cam follower member 75 is located above the bottom plate 21*b*, a downward open recess in which the cam follower member 75 can be fitted may be formed.

Next, a description will be given to the arrangement structure of the ink supply tube 20 which has flexibility and always connects the respective ink cartridges 19 housed in the ink storage part 15 and the recording head 4 of the recording part 7.

In the embodiment, the respective ink supply tubes 20*a* to 20*d* are tube bodies independent of each other, and the lengths of all the ink supply tubes 20*b* to 20*d* are made equal to each other and are used.

As shown in FIGS. 4 and 5, root parts of the plural (four in the embodiment) ink supply tubes 20 are bundled at a portion of one end part 15*a* of the ink storage part 15, and are extended on the upper surface of the lower cover body 29 from one side end part thereof (right end part in FIG. 4) to the other end part (left end part in FIG. 4) in the Y-axis direction. At this time, the root parts of all the ink supply tubes 20*a* to 20*d* are arranged in a single row along the upper surface of the substantially horizontal lower cover body 29. At least a part (middle part or the like) of the ink supply tube 20 is supported on the upper surface of the lower cover body 29.

Next, all the ink supply tubes 20*a* to 20*d* are twisted so that the middle parts thereof extend along one longitudinal surface (almost vertical surface) of an oblong longitudinal partition plate 32 of the lower cover body 29, and the middle parts of all the ink supply tubes 20*a* to 20*d* are arranged in a single file and are fixed (held or pinched) between the one longitudinal surface and a longitudinal plate-shaped fixing body 33 made of synthetic resin and fixed by screws or the like to face the one longitudinal surface of the longitudinal partition plate 32. The portion where all the ink supply tubes 20*a* to 20*d* are fixed (held) by the fixing body 33 and the one longitudinal surface of the longitudinal partition plate 32 becomes an intermediate fixing part.

The carriage 5 is provided with a coupling piece 34 substantially horizontally extending in the sheet transportation downstream direction (direction of the arrow A), and the tip parts of all the ink supply tubes 20*a* to 20*d* are connected, in the arrangement of a substantially horizontal single row, to a coupling part (connection part) 35 of the coupling piece 34 provided at the left end in FIG. 4. The directions of the middle parts of all the ink supply tubes 20*a* to 20*d* are changed from left to right in a portion between the place of the intermediate fixing part (fixing body 33) and the coupling part (connection part) 35, and the ink supply tubes are twisted and routed so that the phases of the lines (arrangement) of all the ink supply tubes 20*a* to 20*d* are changed from the substantially vertical direction at the intermediate fixing part (fixing body 33) side to the substantially horizontal direction at the coupling part (connection part) 35 side. By this, while the respective ink supply tubes 20*a* to 20*d* are bent independently of one another, all the ink supply tubes 20*a* to 20*d* can be easily arranged. It is of course that all the ink supply tubes 20*a* to 20*e* are independently separate from one another between the place of the intermediate fixing part (fixing body 33) and the coupling part (connection part) 35.

In this embodiment, a flexible flat cable 40 for transmitting, from a not-shown control part provided at the housing 2 side, instruction signals to discharge ink droplets selectively from nozzles of the recording head 4 mounted on the carriage 5 is disposed, substantially in parallel to the direction of extension of the ink supply tube 20, in an area (movable area, untied or unrestrained area) through which the ink supply tubes 20*a* to 20*e* pass in the case of reciprocal movement of the carriage 5 in the Y-axis direction (main scanning direction) 5 (see FIGS. 4 and 5).

The convex curved direction of the curved middle part of the ink supply tube 20 and that of the curved middle part of the flexible flat cable 40 are set to be opposite to each other with respect to the reciprocal movement direction of the carriage 5. By adopting the structure as stated above, the ink supply tube 20 and the flexible flat cable 40 can be arranged almost at the same height (almost on the same horizontal surface) in the vertical direction, and as a result, the whole image recording apparatus 1 can be made thin.

As described above, in the image recording apparatus 1, engagement pawls 61 are integrally formed to protrude upward on upper end surfaces of the pair of side plates, and the engagement pawls are fitted in locking holes respectively provided in the first guide member and the second guide member and are bent or twisted and crimped.

Thus, the fitting work is simple, the number of parts is not increased contrary to the case of screwing, and there is no backlash in the respective guide members.

Also, positioning convex parts 21*f* to regulate horizontal setting height positions of the first guide member and the second guide member are formed on the upper end surfaces of the pair of side plates.

Therefore, only by fitting the two guide members 22, 23 to the main frame, the basis of the parallelism, levelness and the like of the carriage at the time of movement in the main scanning direction or the like can be easily and accurately determined, and the reference position or the reference surface having a direct influence on the quality of image recording can be easily regulated. Thus, there is obtained an effect that the assembly of the image recording apparatus 1 can be improved and simplified.

Further, a horizontal and a height position of the carriage are regulated by horizontal guide parts 51, 52 of the first guide member and the second guide member, and a position of the carriage in the sub-scanning direction is regulated by a guide piece of the second guide member in a vertical direction.

Thus, the horizontal and the height position of the carriage 5 are regulated by the horizontal guide parts 51, 52 of the first guide member and the second guide member, and the position of the carriage in the sub-scanning direction is regulated by the guide piece of the second guide member in the vertical direction. Thus, the quality of a recorded image onto the recording medium by the recording head mounted on the carriage can be raised by the simple structure.

In addition, the main frame 21 is housed and fixed in a main body case of the image recording apparatus 1, a paper feed cassette 3 in which the recording medium is stacked and housed is disposed below a bottom plate coupling the pair of side plates of the main frame and is capable of being pulled out and inserted, and a paper feed unit to feed the recording medium deposited in the paper feed cassette is mounted to the bottom plate to be capable of vertically swinging.

Since the main frame is housed and fixed, and the vertically swinging paper feed unit is mounted to the bottom plate to couple the pair of side plates of the main frame, the attachment strength of the paper feed unit can be improved.

Further, the bottom plate 21*b* includes an opening part or a housing recess to enable the paper feed unit swung upward to be housed on an upper surface side of the bottom plate.

Since the paper feed unit upward swung can be housed on the upper surface side of the bottom plate in the opening part or the housing recess formed in the bottom plate, the height of the vertical space from the paper feed cassette to the bottom plate can be made small, and the image recording apparatus 1 having a small height size and being compact can be provided.

Additionally, the bottom plate 21*b* includes a shaft support plate 71 to pivotally support a base end part of a paper feed arm of the paper feed unit.

Thus, most of the paper feed arm at the time of the upward swing can be housed above the bottom plate, and the image recording apparatus 1 having a further small height size and being compact can be provided.

Also, a drive shaft to drive a paper feed roller 6*b* of the paper feed unit is pivotally supported by the shaft support plate concentrically with the base end part of the paper feed arm 6*a*.

Thus, the structure for transmission of the driving force to the paper feed roller 6*b* becomes simpler.

Further, the paper feed unit includes a cam follower member positioned below the bottom plate, and the paper feed cassette includes a cam part which, together with the cam follower member, raises/lowers/swings the paper feed unit at least temporarily according to advancing/retracting movement of the paper feed cassette in the main body case.

Accordingly, the paper feed unit 6 can be raised and lowered according to the loading and unloading operation of the paper feed cassette 3, and the operation becomes simple.

Also, at a time when the paper feed unit 6 rises to a highest position, the cam follower member 75 is substantially in contact with or close to a lower surface of the bottom plate.

Thus, at the time of rising, the cam follower member 75 is also put in the state where it is in contact with or close to the lower surface of the bottom plate, and accordingly, the vertical swing operation of the paper feed unit 6 can be ensured without enlarging the height of the vertical space between the bottom of the main frame and the paper feed cassette. In other words, the height from the paper feed cassette to the bottom plate of the main frame can be made low, and there is obtained an effect that the height size of the whole image recording apparatus 1 is made small and a compact one can be provided.

In addition, the side plates of the main frame 21 and the shaft support plate include projections 72 to regulate a setting height position of a flat platen which faces a lower surface of the carriage and supports the recording medium.

Thus, the size of the gap between the lower surface of the recording head mounted on the carriage and the platen can be easily regulated, and the assembling work can be simplified.

Furthermore, at one end parts of the first guide member 22 and the second guide member 23 in the main scanning direction, an attachment part by which a maintenance unit to maintain the carriage is mounted to extend over both the guide members is provided.

Thus, since the maintenance unit 50 can be attached to the high rigidity place obtained by the assembly of these plural members, the attachment strength of the attachment part of the maintenance unit can be strengthened without using an added member.

Additionally, the main frame 21 is formed by stamping one flat plate and bending it.

Since the main frame 21 is formed by stamping one flat plate and bending it, the forming work becomes simple, and the manufacture cost can be reduced.

Also, attachment parts for a transportation roller to transport the recording medium in the sub-scanning direction and a paper discharge roller are cut and formed in the pair of side plates of the main frame 21.

According to this structure, there is obtained an effect that the assembling work of the respective parts (rollers) becomes easy.

Further, the paper discharge roller 28 includes a pair of right and left guidance bodies to guide both side edges of the recording medium extending in the sub-scanning direction and to prevent the recording medium from drooping when it is transported.

Thus, both the side edges of the discharged recording medium extending in the sub-scanning direction are curved upward by the pair of guidance bodies. Accordingly, since this recording medium is discharged in a substantially U-shaped form, the sheet P does not droop down and is stacked such that after the sheet is straightly transported in the transporting direction, it falls onto the paper discharge part when coming off the paper discharge roller. By adopting the structure as stated above, there is obtained an effect that it is possible to get time for ink of the recording medium previously recorded to dry.

Furthermore, ink is supplied from an ink storage part provided at a stationary position of a main body of the image recording apparatus 1 through a flexible ink supply tube connected to the carriage.

Accordingly, as compared with the case where a storage part of an ink cassette or the like is provided in the carriage, there is obtained an effect that the image recording apparatus 1 can be made short in height and compact.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image recording apparatus comprising:

a carriage that carries a recording head capable of recording an image on a recording medium and reciprocates in a main scanning direction;

a substantially box-shaped main frame having an open upper side and a pair of side plates extending in a sub-scanning direction orthogonal to the main scanning direction; and first and second guide members over which the carriage extends and by which the carriage is guided, the first and second guide members being disposed to be apart from each other by a predetermined distance in the sub-scanning direction, and each of the first and second guide members including a flat plate which has an upper surface and a lower surface opposing the upper surface and which extends horizontally in the main scanning direction at the upper side of the main frame and fixed to the pair of side plates;

wherein engagement pawls are integrally formed to protrude upward on upper end surfaces of the pair of side plates, and the engagement pawls are fitted in locking holes respectively provided in the flat plates of the first and second guide members such that upper end portions of the engagement pawls protrude upward from the upper surfaces of the flat plates, and at least a part of each engagement pawl is deflected toward the main scanning direction with respect to a corresponding locking hole;

wherein positioning convex parts to regulate horizontal setting height positions of the first and second guide members are formed on the upper end surfaces of the pair of side plates, and an upper end portion of each positioning convex part abuts the lower surface of a corresponding flat plate to regulate horizontal setting height position of the corresponding guide member; and wherein the positioning convex parts are positioned at a lower position than the corresponding flat plate, and the engagement pawls are positioned at a higher position than the corresponding flat plate.

2. The image recording apparatus according to claim 1, wherein the engagement pawls fitted in the locking holes are bent or twisted.

3. The image recording apparatus according to claim 1, wherein positioning convex parts to regulate horizontal setting height positions of the flat plates of the first and second guide members are formed in upper end surfaces of the pair of side plates.

4. The image recording apparatus according to claim 1, wherein a horizontal position and a height position of the carriage are regulated by horizontal guide parts of the first and second guide members, and a position of the carriage in the sub-scanning direction is regulated by a guide piece of the second guide member which extends in a vertical direction.

5. The image recording apparatus according to claim 1, further comprising:

a main body case that houses and fixes the main frame therein;

a paper feed cassette in which the recording medium is stacked and housed, the paper feed cassette being disposed below a bottom plate that couples the pair of side plates of the main frame and is capable of being pulled out and inserted; and a paper feed unit to feed the recording medium stacked in the paper feed cassette, the paper feed unit being mounted to the bottom plate to be capable of swinging vertically.

6. The image recording apparatus according to claim 5, wherein the bottom plate includes an opening part or a housing recess to enable the paper feed unit swung upward to be housed to an upper surface side of the bottom plate.

7. The image recording apparatus according to claim 6, wherein the bottom plate includes a shaft support plate to pivotally support a base end part of a paper feed arm of the paper feed unit.

8. The image recording apparatus according to claim 7, wherein a drive shaft to drive a paper feed roller of the paper feed unit is pivotally supported by the shaft support plate concentrically with the base end part of the paper feed arm.

9. The image recording apparatus according to claim 7, wherein the side plates of the main frame and the shaft support plate include projections to regulate a setting height position of a flat platen which faces a lower surface of the carriage and supports the recording medium.

10. The image recording apparatus according to claim 5, wherein the paper feed unit includes a cam follower member positioned below the bottom plate; and the paper feed cassette includes a cam part which, together with the cam follower member, swings the paper feed unit at least temporarily according to pulling or inserting movement of the paper feed cassette with respect to the main body case.

11. The image recording apparatus according to claim 5, wherein at a time when the paper feed unit rises to a highest position, a cam follower member is substantially in contact with or close to a lower surface of the bottom plate.

12. The image recording apparatus according to claim 1, wherein at one end parts of the first guide member and the second guide member in the main scanning direction, an attachment part by which a maintenance unit to maintain the carriage is mounted to extend over both the guide members is provided.

13. The image recording apparatus according to claim 1, wherein the main frame is formed by stamping one flat plate and bending it.

14. The image recording apparatus according to claim 1, wherein attachment parts for a transporting roller to transport the recording medium in the sub-scanning direction and a paper discharge roller are cut and formed in the pair of side plates of the main frame.

15. The image recording apparatus according to claim 14, wherein the paper discharge roller includes a pair of right and left guidance bodies to guide both side edges of the recording medium extending in the sub-scanning direction and to prevent the recording medium from drooping when it is transported.

16. The image recording apparatus according to claim 1, wherein ink is supplied from an ink storage part provided at a stationary position of a main body of the image recording apparatus through a flexible ink supply tube connected to the carriage.

17. The image recording apparatus according to claim 1, wherein the main frame comprises at least one reinforcement plate that couples one end parts of the pair of side plates.

18. The image recording apparatus according to claim 1, wherein the engagement pawls comprise T-shaped engagement pawls.

19. The image recording apparatus according to claim 1, wherein a pair of protrusions protruding at both sides of the engagement pawl are formed on the upper end surface of each of the side plates and are fitted in positioning holes formed in at least one of the flat plates of the first and second guide members.

20. The image recording apparatus according to claim 1, wherein the main frame is formed of one metal sheet.

21. The image recording apparatus according to claim 1, wherein one of the first and second guide members which is disposed on a downstream side in a recording medium transporting direction is equipped with a spur roller that is opposed to a paper discharge roller and a holder that holds the spur roller.

22. The image recording apparatus according to claim 21, wherein one of the first and second guide members which is disposed on the downstream side is further equipped with an auxiliary spur roller that is disposed on an upstream side in the recording medium transporting direction of the spur and a holder that holds the auxiliary spur roller.

* * * * *